US012529184B2

(12) United States Patent
Bodine et al.

(10) Patent No.: US 12,529,184 B2
(45) Date of Patent: Jan. 20, 2026

(54) LAUNDRY APPLIANCE WITH SLIDING DOOR SYSTEM

(71) Applicant: WHIRLPOOL CORPORATION, Benton Harbor, MI (US)

(72) Inventors: Darryl Cedric Bodine, Benton Harbor, MI (US); Eric Andrew Hill, Chicago, IL (US); J. Carroll Mays, London (GB); Patrick Aaron McCormick, Clarendon Hills, IL (US); Sayer James Murphy, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/820,507

(22) Filed: Aug. 30, 2024

(65) Prior Publication Data

US 2024/0426042 A1 Dec. 26, 2024

Related U.S. Application Data

(63) Continuation of application No. 17/837,112, filed on Jun. 10, 2022, now Pat. No. 12,084,803.

(60) Provisional application No. 63/210,629, filed on Jun. 15, 2021.

(51) Int. Cl.

| | |
|---|---|
| ***D06F 39/14*** | (2006.01) |
| ***D06F 33/30*** | (2020.01) |
| ***D06F 34/14*** | (2020.01) |

(52) U.S. Cl.
CPC ..... *D06F 39/14* (2013.01); *D06F 33/30* (2020.02); *D06F 34/14* (2020.02)

(58) Field of Classification Search
CPC ..... D06F 34/20; D06F 37/28; D06F 37/42; D06F 39/14; D06F 2103/40; D06F 2105/44; D06F 33/30; D06F 21/04; D06F 23/02; D06F 23/025
See application file for complete search history.

(56) References Cited

U.S. PATENT DOCUMENTS

| | | | |
|---|---|---|---|
| 3,116,903 | A | 1/1964 | Grantham |
| 7,490,495 | B2 | 2/2009 | Kim |
| 9,457,384 | B2 | 10/2016 | Heitmann |
| 10,105,032 | B2 | 10/2018 | Wilson |
| 10,585,407 | B2 | 3/2020 | Bodine et al. |
| 10,793,993 | B2 | 10/2020 | Yang et al. |
| 10,908,762 | B2 | 2/2021 | Bodine et al. |
| 2005/0015892 | A1 | 1/2005 | Park et al. |
| 2006/0086151 | A1 | 4/2006 | Kim et al. |
| 2006/0090521 | A1 | 5/2006 | Kim et al. |
| 2015/0005943 | A1 | 1/2015 | Bodine et al. |
| 2017/0137985 | A1 | 5/2017 | Kim |
| 2017/0191204 | A1 | 7/2017 | Shin et al. |

(Continued)

FOREIGN PATENT DOCUMENTS

| | | | |
|---|---|---|---|
| CN | 106868807 | A | 6/2017 |
| EP | 1367169 | A1 | 12/2003 |

(Continued)

*Primary Examiner* — David G Cormier
(74) *Attorney, Agent, or Firm* — Price Heneveld LLP

(57) ABSTRACT

A door system for an appliance includes a panel and a door having an inner surface. A bracket is coupled to the door. A rail assembly is disposed on an opposing side of the panel relative to the door. The bracket engages the rail assembly through the panel to adjust the door between an opened position and a closed position via the rail assembly. The door is configured to a deployed position.

20 Claims, 18 Drawing Sheets

(56) References Cited

U.S. PATENT DOCUMENTS

| | | | |
|---|---|---|---|
| 2019/0024287 | A1 | 1/2019 | Kim et al. |
| 2019/0032269 | A1 | 1/2019 | Gijare et al. |
| 2020/0208324 | A1 | 7/2020 | Bodine et al. |
| 2020/0370222 | A1 | 11/2020 | Bodine et al. |
| 2020/0370233 | A1 | 11/2020 | Bodine et al. |
| 2022/0381062 | A1 | 12/2022 | Choi et al. |

FOREIGN PATENT DOCUMENTS

| | | | |
|---|---|---|---|
| EP | 2481845 | B1 | 8/2012 |
| EP | 3130696 | A1 | 2/2017 |
| KR | 1020200042180 | A | 4/2020 |
| WO | 2012172016 | A | 12/2012 |

LAUNDRY APPLIANCE WITH SLIDING DOOR SYSTEM

CROSS-REFERENCE TO RELATED APPLICATIONS

This application is a continuation of and claims priority to U.S. patent application Ser. No. 17/837,112, filed Jun. 10, 2022, now U.S. Pat. No. 12,084,803, entitled "LAUNDRY APPLIANCE WITH SLIDING DOOR SYSTEM, which claims priority to U.S. Provisional Patent Application No. 63/210,629, filed on Jun. 15, 2021, entitled "LAUNDRY APPLIANCE WITH SLIDING DOOR SYSTEM," the disclosure of which is hereby incorporated herein by reference in its entirety.

BACKGROUND OF THE DISCLOSURE

The present disclosure generally relates to a laundry appliance, and more specifically, to a laundry appliance with a sliding door system.

SUMMARY OF THE DISCLOSURE

According to one aspect of the present disclosure, a laundry appliance includes a cabinet having a front panel. A rail assembly is disposed within the cabinet proximate to the front panel. A door is operable between a closed position and an opened position via the rail assembly. A bracket is coupled to the door. The bracket extends into the cabinet to engage the rail assembly. A sensor is coupled to the cabinet. The door is operable between the opened position and the closed position in response to a triggering event sensed by the sensor. A controller is in communication with the sensor and the rail assembly. The controller is configured to automatically adjust a movement path of the door in response to a detected obstruction in the movement path.

According to another aspect of the present disclosure, an appliance door system includes a panel having a front surface. A door is disposed proximate to the front surface. A rail assembly is disposed on an opposing side of the panel relative to the door. A bracket is coupled to the door, wherein the bracket extends through the panel to engage the rail assembly. The door is operable along a first movement path between an opened position and a closed position along the front surface of the panel via the rail assembly. A deploying assembly is coupled to the bracket and the door. The door is configured to rotate along a second movement path to a deployed position. The deploying assembly is configured to retain the door in the deployed position.

According to yet another aspect of the present disclosure, a door system for an appliance includes a panel and a door having an inner surface. A bracket is coupled to the door. A rail assembly is disposed on an opposing side of the panel relative to the door. The bracket engages the rail assembly through the panel to adjust the door between an opened position and a closed position via the rail assembly. The door is configured to rotate to a deployed position.

These and other features, advantages, and objects of the present disclosure will be further understood and appreciated by those skilled in the art by reference to the following specification, claims, and appended drawings.

Figure 1:
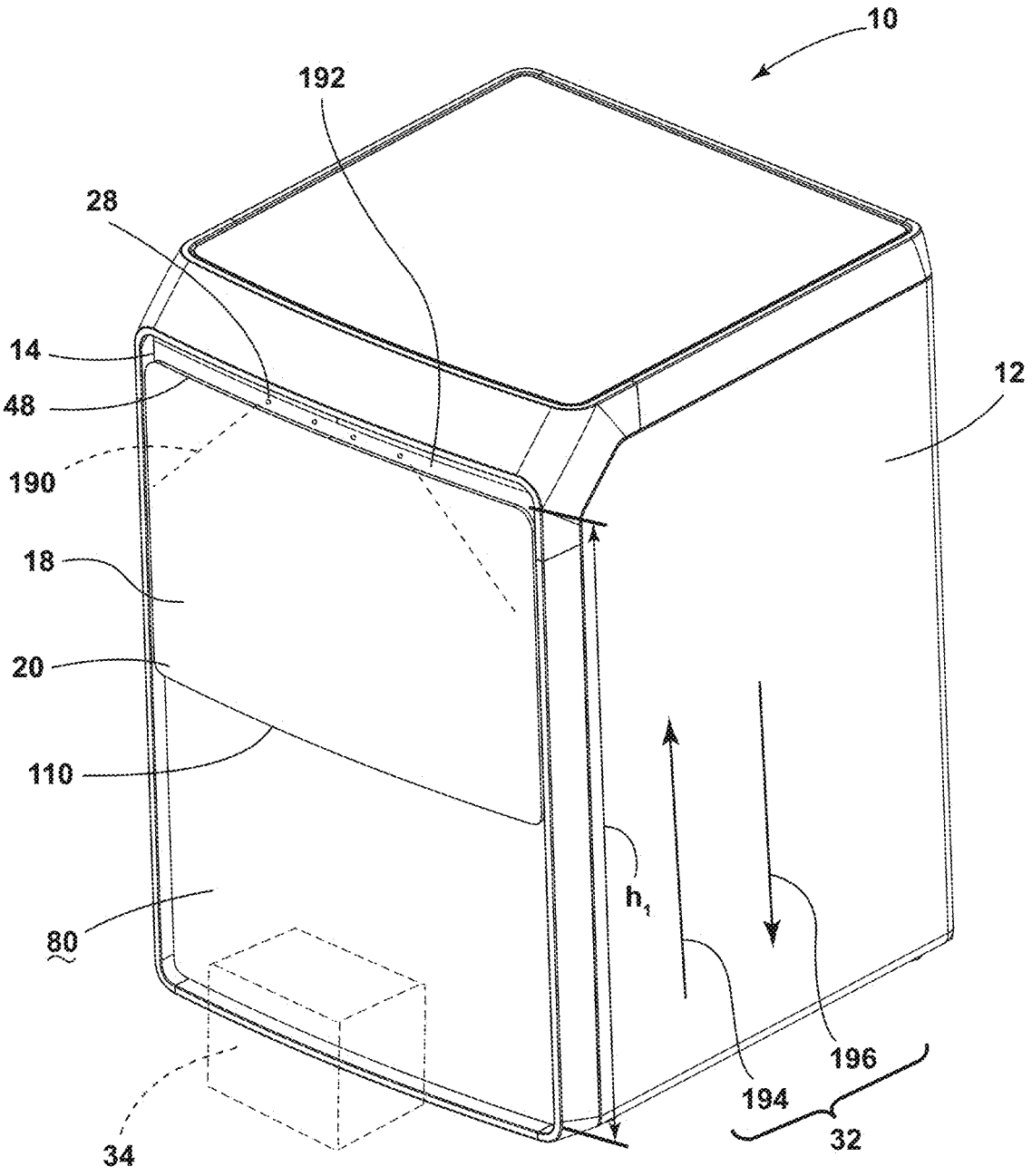
FIG. 1 is a side perspective view of a laundry appliance with a sliding door in a raised, closed position, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance with a sliding door system. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-18, reference numeral 10 generally designates a laundry appliance that includes a cabinet 12 having a front panel 14. A rail assembly 16 is disposed within the cabinet 12 proximate to the front panel 14. A door 18 is operable between a closed position 20 and an opened position 22 via the rail assembly 16. Brackets 24, 26 are coupled to the door 18 and extend through the front panel 14 to engage the rail assembly 16. A sensor 28 is coupled to the cabinet 12. The door 18 is operable between the opened position 22 and the closed position 20 in response to a triggering event sensed by the sensor 28. The controller 30 is in communication with the sensor 28 and the rail assembly 16. The controller 30 is configured to automatically adjust motion of the door 18 along a first movement path 32 of the door 18 in response to a least one of the triggering event and a detected obstruction or object 34 in the first movement path 32.

Figure 2:
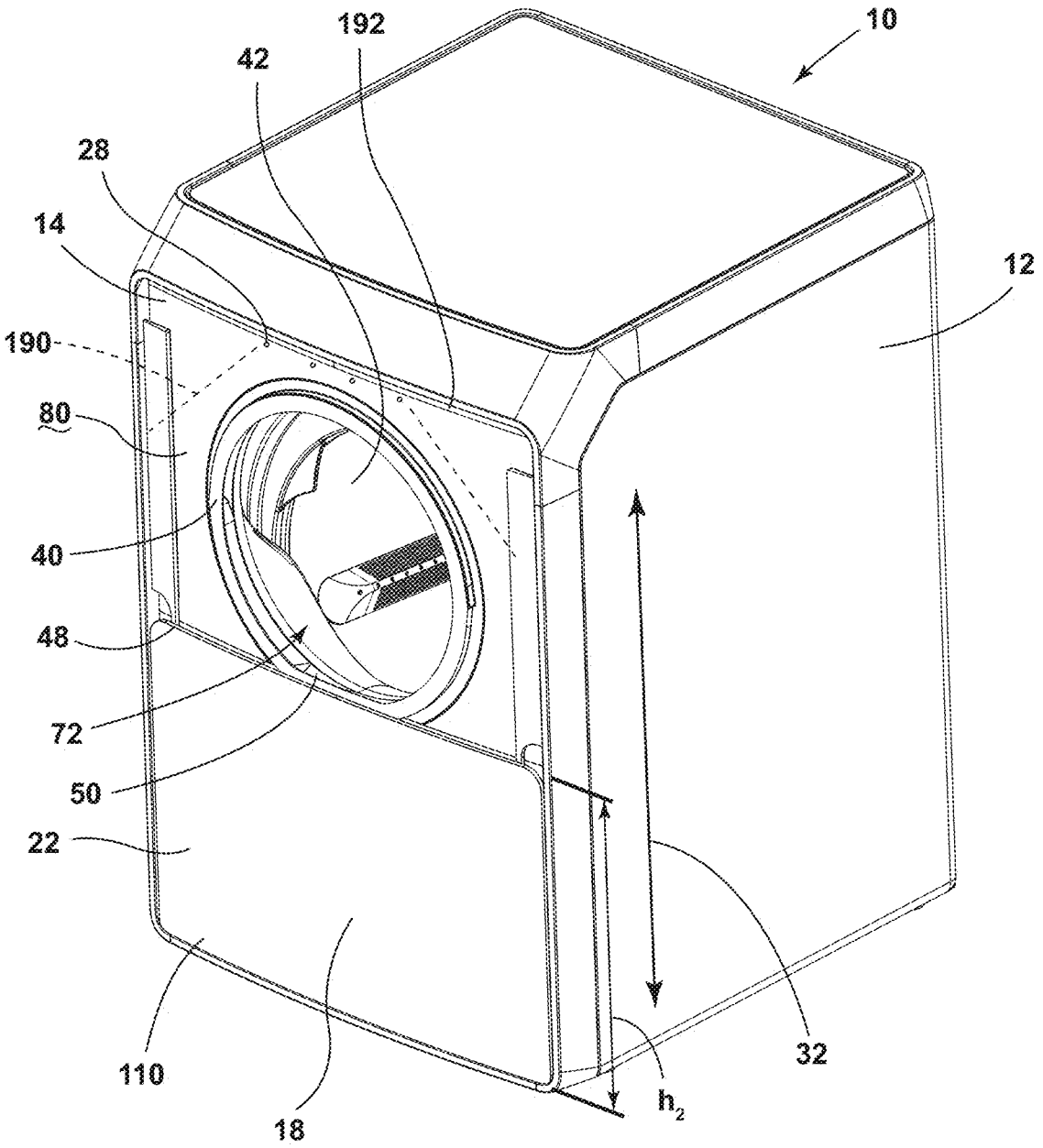
FIG. 2 is a side perspective view of a laundry appliance with a sliding door in a lowered, opened position, according to the present disclosure.

Referring to FIGS. 1 and 2, the laundry appliance 10 is illustrated as a front load washer. The laundry appliance 10 may also be a top load washer, dryer, a combination washer/dryer, other laundry appliance, or other appliance. In the illustrated example, the front panel 14 of the cabinet 12 defines a front opening 40 for accessing a drum 42 within an interior of the laundry appliance 10. A tub 44 is disposed within the cabinet 12 and defines an access opening 46, which is generally aligned with the front opening 40.

The door 18 is operably coupled to the cabinet 12 for sealing the front opening 40 when the door 18 is in the closed position 20 and providing access to the drum 42 when in the opened position 22, as well as other non-closed positions, as described herein. The door 18 is generally a sliding panel door 18. The sliding panel door 18 may be flat, planar, arcuate, or have surfaces of different shapes. In the illustrated example of FIGS. 1 and 2, the closed position 20 is generally a raised position and the opened position 22 is generally a lowered position. Accordingly, the door 18 is configured to slide vertically between a first height $h_1$ when in the closed position 20 and a second height $h_2$ when in the opened position 22.

A position of the front opening 40 on the front panel 14 may be vertically higher and/or larger than openings on conventional washers. The door 18 sliding vertically along the first movement path 32 moves to fully cover the front opening 40 and be fully removed from the front opening 40. In this way, when in the opened position 22, a top edge 48 of the door 18 is at or below a bottom edge 50 of the front opening 40. The front opening 40 is then at least substantially, or entirely, free of obstruction (e.g., the door 18), which may be advantageous for loading and unloading laundry from the laundry appliance 10. Additionally, the higher position or height of the front opening 40 may provide increased access or more convenient access to the drum 42 for the user.

Additionally or alternatively, the sliding door 18 generally does not include any conventional hinges or latches for coupling the door 18 to a fixed vertical position on the front panel 14, as are typically used for conventional swinging or rotating doors. The absence of such hinges and latches frees space on the front panel 14 for increasing a size of the front opening 40. Moreover, the absence of the conventional door hinges and latches provides a smoother and more uniform aesthetic to the laundry appliance 10.

Figure 3:
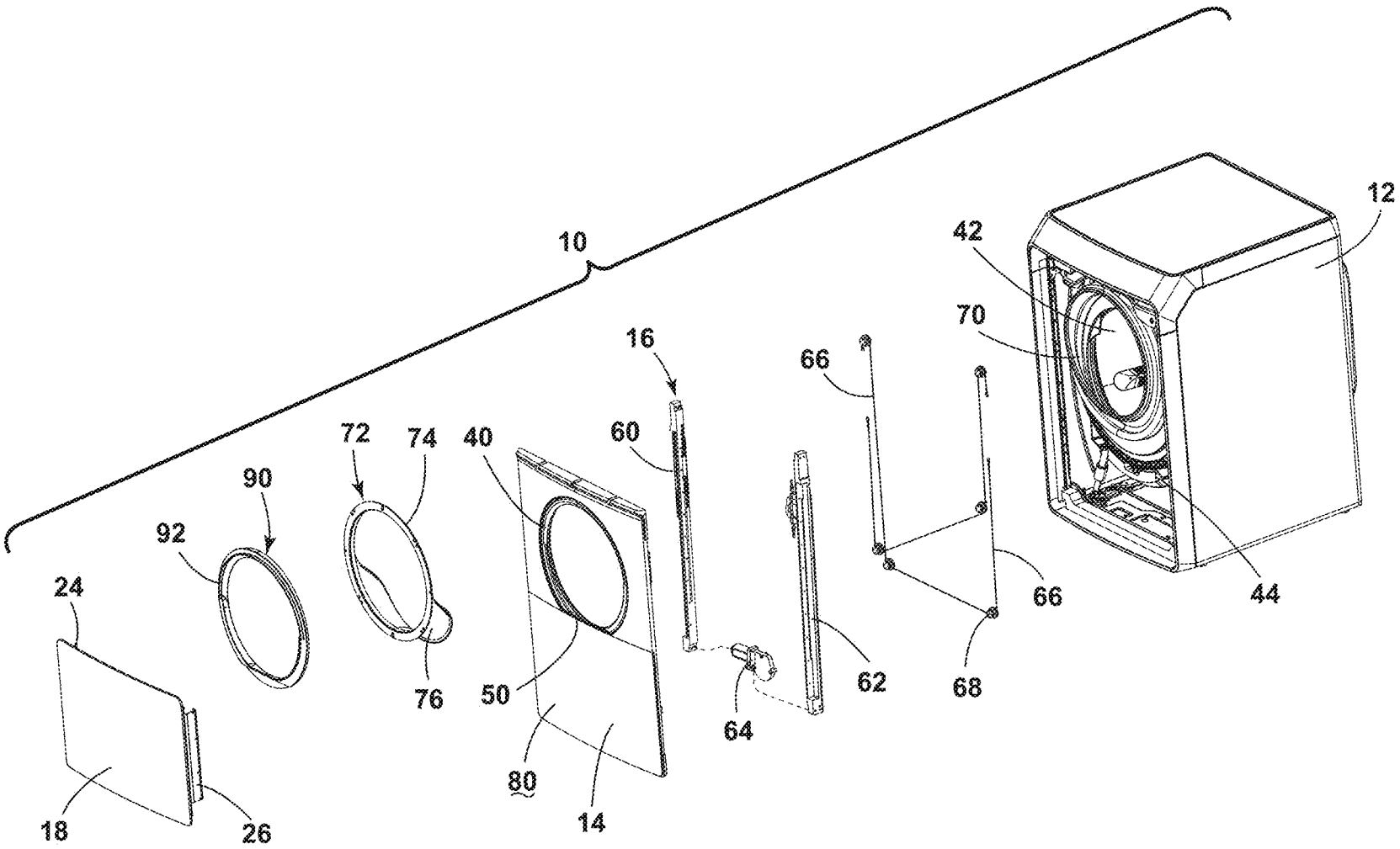
FIG. 3 is a side perspective exploded view of a laundry appliance having a rail assembly, a seal assembly, and a deflector, according to the present disclosure.

Referring to FIG. 3, the laundry appliance 10 includes the rail assembly 16 disposed behind the front panel 14 and within the cabinet 12. The rail assembly 16 includes two rails 60, 62 that extend vertically within the cabinet 12. One rail 60, 62 is disposed on each side of the access opening 46 of the tub 44, as well as on each side of the front opening 40 of the front panel 14. The brackets 24, 26 extend through the front panel 14 to engage the rail assembly 16. In this way, the door 18 is on an opposing side of the front panel 14 relative to the rail assembly 16. It is contemplated that the rails 60, 62 may be coupled to the front panel 14, or alternatively may be coupled to other panels of the cabinet 12. The front panel 14 is configured to guide the motion of the brackets 24, 26 and conceals the inner structure (including the rails 60, 62) of the laundry appliance 10.

The brackets 24, 26 each engage one of the rails 60, 62, respectively. The rail assembly 16 includes a motor 64 to provide motorized movement for the door 18. The motor 64 operates to drive the brackets 24, 26 along the rail 60, 62 to adjust the door 18 between the closed and opened positions 20, 22. It is contemplated that the brackets 24, 26 may be configured as slide brackets 24, 26 that directly engage the rails 60, 62, or alternatively, the brackets 24, 26 may engage separate rail slides, which engage the rails 60, 62.

It is contemplated that the laundry appliance 10 may include a single rail 60. In such examples, a single bracket 24 is coupled to the door 18, extending through the cabinet 12 to the rail 60. The single rail 60 carries the entire load of the door 18 between the closed position 20 and the opened position 22.

The rail assembly 16 may include a drive system, such as cables 66 and guide features 68. The cables 66 are directed along the guide features 68. Additionally or alternatively, the guide features 68 may assist in controlling movement of the cables 66. The cables 66 may assist with the motorized movement of the brackets 24, 26 relative to the rails 60, 62.

The drive system can also include a chain drive, screw drive, and other drive and guide mechanisms.

Additionally or alternatively, the movement of the brackets 24, 26 along the rails 60, 62 may be completely manual. In such examples, the user applies a force to adjust the door between the closed and opened positions 20, 22. The laundry appliance 10 uses linear counterbalancing springs to allow manual movement of the door 18 with a more lightweight feeling for the user for more convenient movement. The engagement between the brackets 24, 26 and the rails 60, 62 may be configured to retain the brackets 24, 26 along the rails 60, 62 based on the manual adjustment of the door 18. Further, the door 18 may include a handle or other grasping feature or location to assist in the manual adjustment of the door 18.

Figure 4:
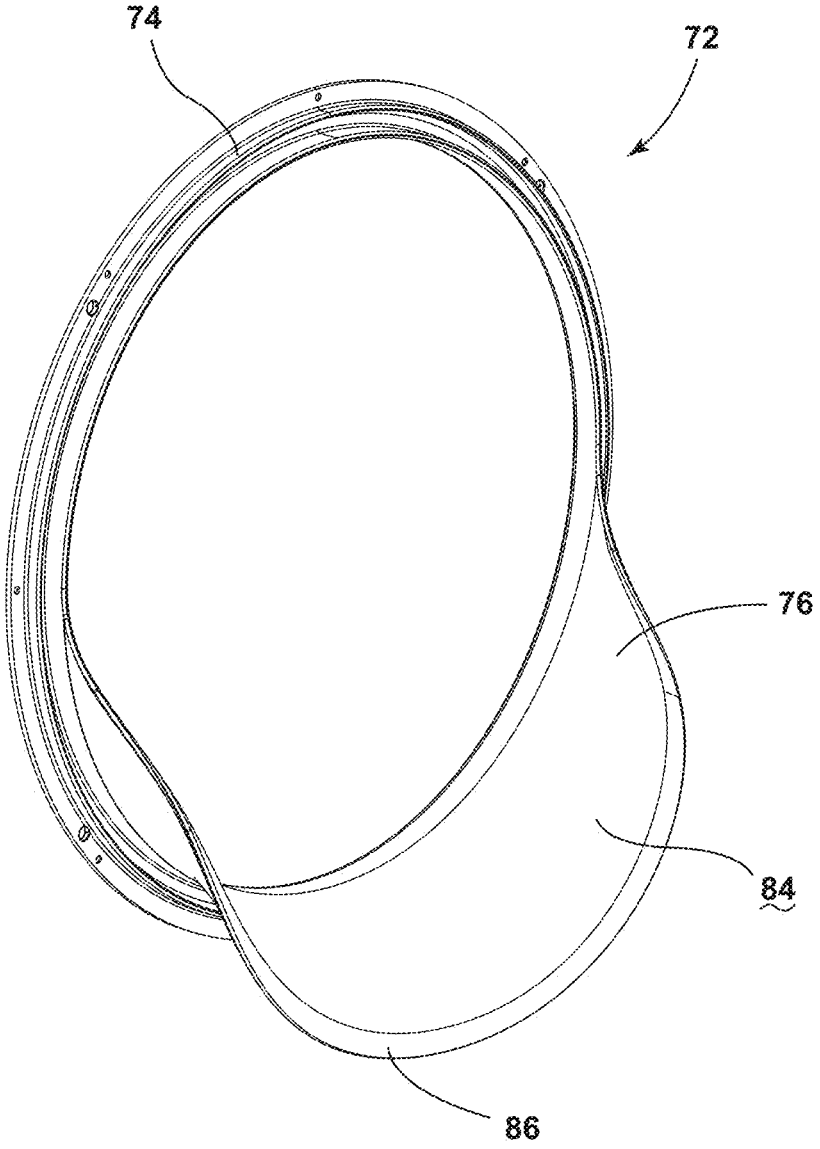
FIG. 4 is a rear perspective view of a deflector having a chute, according to the present disclosure.
Figure 5:
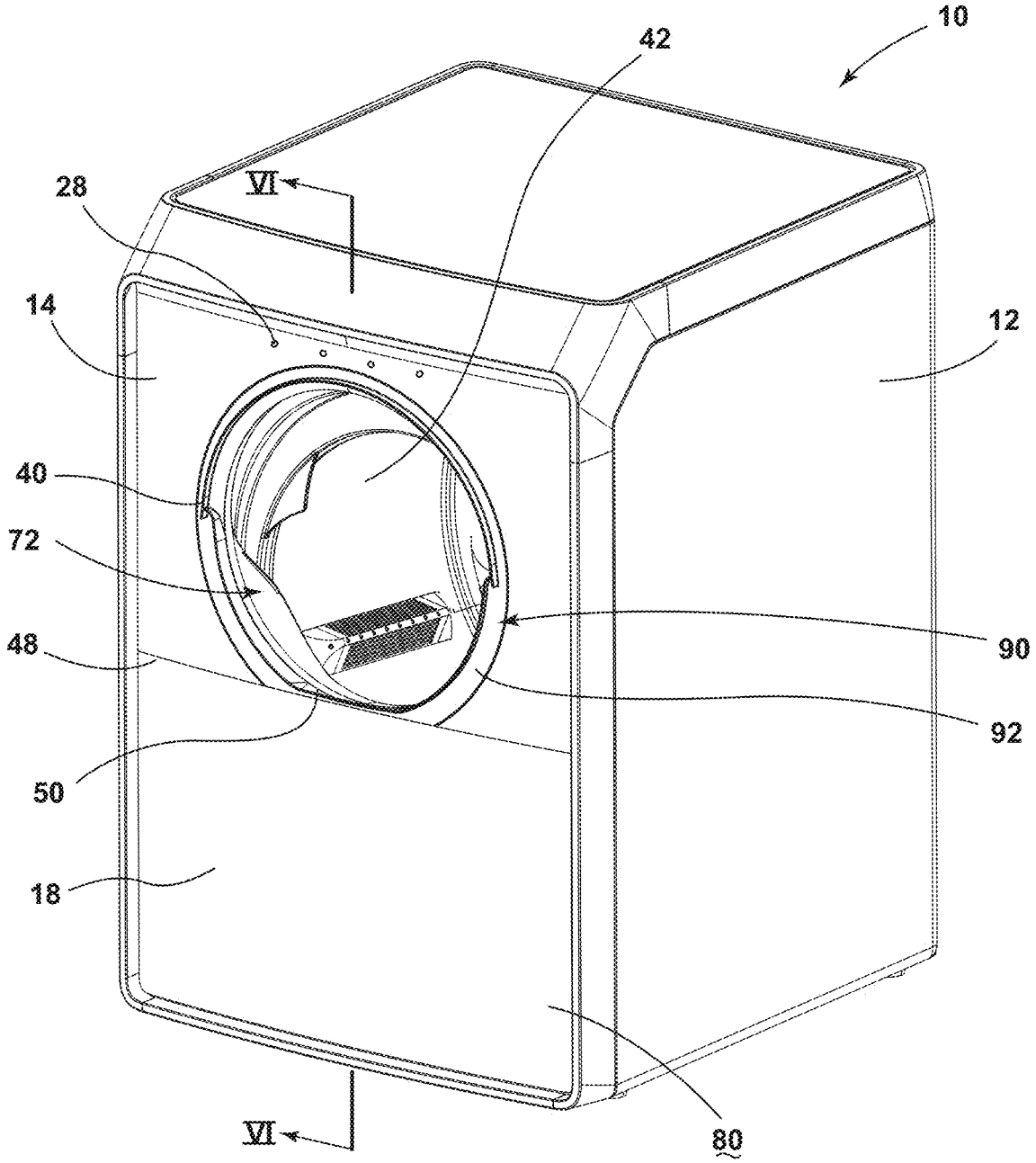
FIG. 5 is a side perspective view of a laundry appliance with a deflector extending into the laundry appliance, according to the present disclosure.
Figure 6:
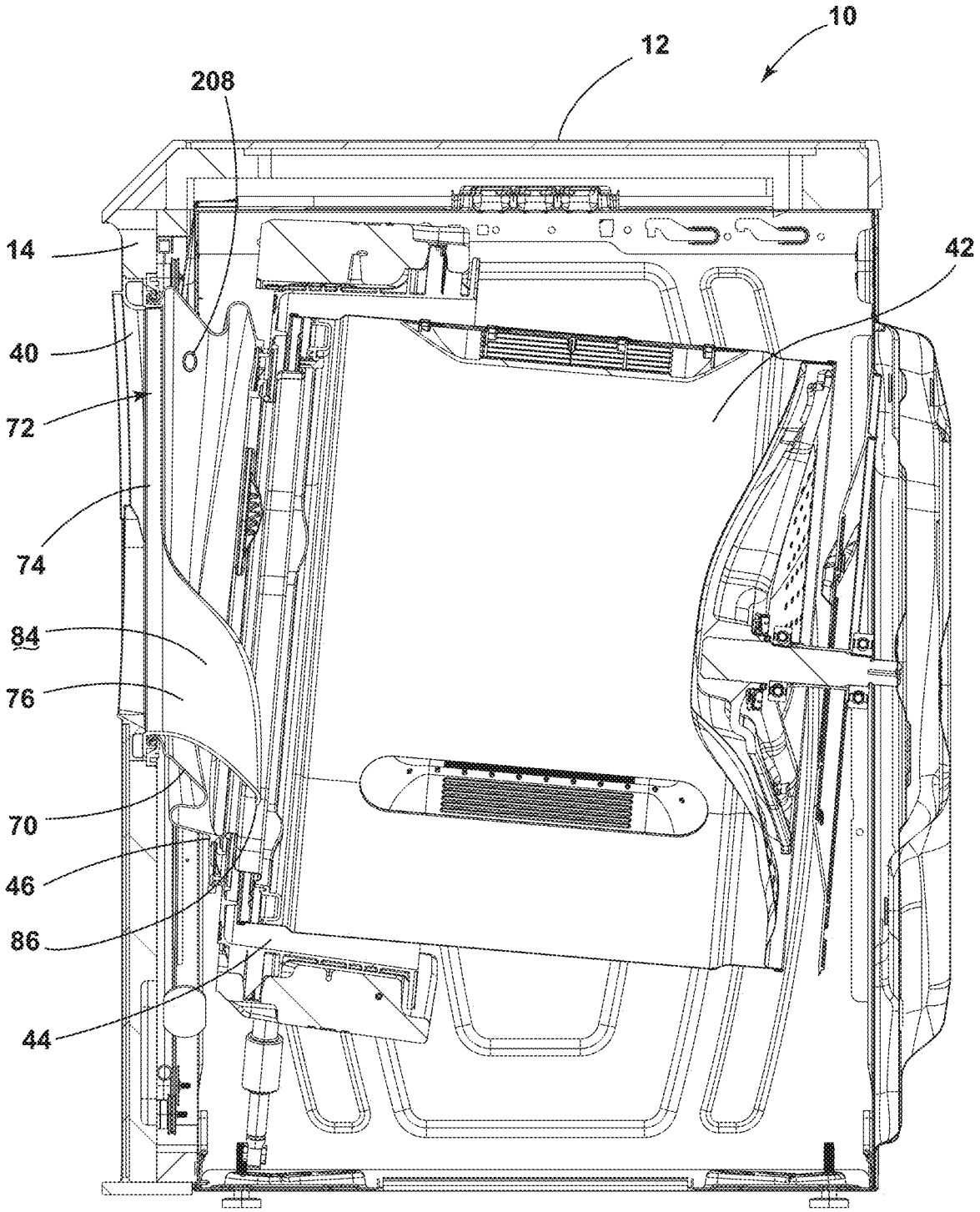
FIG. 6 is a cross-sectional view of the laundry appliance of FIG. 5 taken along line VI-VI with the deflector extending over oblique bellows, according to the present disclosure.

Referring still to FIG. 3, as well as FIGS. 4-6, in certain aspects, the tub 44 is positioned at an angle within the cabinet 12. A bellows 70 is disposed adjacent to the front opening 40 and is typically coupled to the cabinet 12 along the perimeter of the front opening 40. The bellows 70 is also coupled to the tub 44, extending around the perimeter of the access opening 46. The bellows 70 extends between the cabinet 12 and the tub 44. The tub 44 being positioned at an angle causes the access opening 46 to be offset from the front opening 40. Additionally or alternatively, due to the vertical height of the front opening 40, the front opening 40 may be positioned higher than the access opening 46, thereby being offset from the access opening 46.

In examples where the access opening 46 is offset from the front opening 40, the bellows 70 is configured as an obliquely oriented bellows 70. The bellows 70 is configured to form an oblique cylinder or frusto-conical shape the defines a downward angle between the front opening 40 and access opening 46 of the offset or angled tub 44. The bellows 70 is advantageous for retaining laundry and fluid within the drum 42 during a laundry cycle. The bellows 70 forms a sloped surface to direct fluid and laundry into the drum 42 without pooling of fluid or debris on the surface of the bellows 70. The sloped surface of the bellows 70 minimizes pooling on the bellows 70 assists with mitigating biofilm. The bellows 70 is typically a flexible gasket having a plurality of folds or pleats, which generally permits the tub 44 to move substantially independent of the cabinet 12.

Referring still to FIG. 3, as well as to FIGS. 4-6, the laundry appliance 10 includes a deflector 72 coupled to the front panel 14. The deflector 72 extends at least partially or entirely around the front opening 40 of the cabinet 12. The deflector 72 includes a rim 74 and a chute 76. The rim 74 is coupled to the cabinet 12, while the chute 76 extends from the rim 74, over the bellows 70, and into the drum 42. In certain aspects, the rim 74 is coupled to a front surface 80 of the front panel 14. Accordingly, the rim 74 may have a larger width or diameter than the front opening 40.

A user or service technician may position the chute 76 within the laundry appliance 10 and couple the rim 74 to the cabinet 12. Generally, the rim 74 is coupled to the front panel 14 via fasteners or clips. A trim may be coupled to the front panel 14 over the rim 74 to provide more blended aesthetics of the laundry appliance 10 and/or for obscuring the fasteners or clips. The deflector 72 is advantageous for deflecting laundry and fluid away from the bellows 70 and into the drum 42. The deflector 72 is also advantageous for protecting the bellows 70 from contact with the laundry, which can result in premature wear of the bellows 70.

Moreover, the deflector 72 deflects laundry and fluid away from the door 18 and any sealing components. This deflection is particularly advantageous at a 4 o'clock position and an 8 o'clock position of the front opening 40. In comparison, a conventional "fishbowl" projection on a washer door directs water toward a door seal at a 6 o'clock position and increases leak potential. The deflector 72 deflects fluid away from the door 18, resulting in less fluid flow near door sealing components, reducing leak potential.

The rim 74 may have a substantially consistent thickness around the perimeter of the front opening 40 or may gradually increase in thickness around the rim 74, such as from a top to a bottom, to provide increased support for the chute 76. Generally, the chute 76 is arcuate, forming a "duckbill" shape, to follow the curvature of the front opening 40 and the access opening 46. The chute 76 generally has a sloped or angled top surface 84, which assists in directing laundry and fluid back to the drum 42. Additionally, the chute 76 may have a drip edge 86 to assist in controlling fluid directed toward the drum 42.

Figure 7:
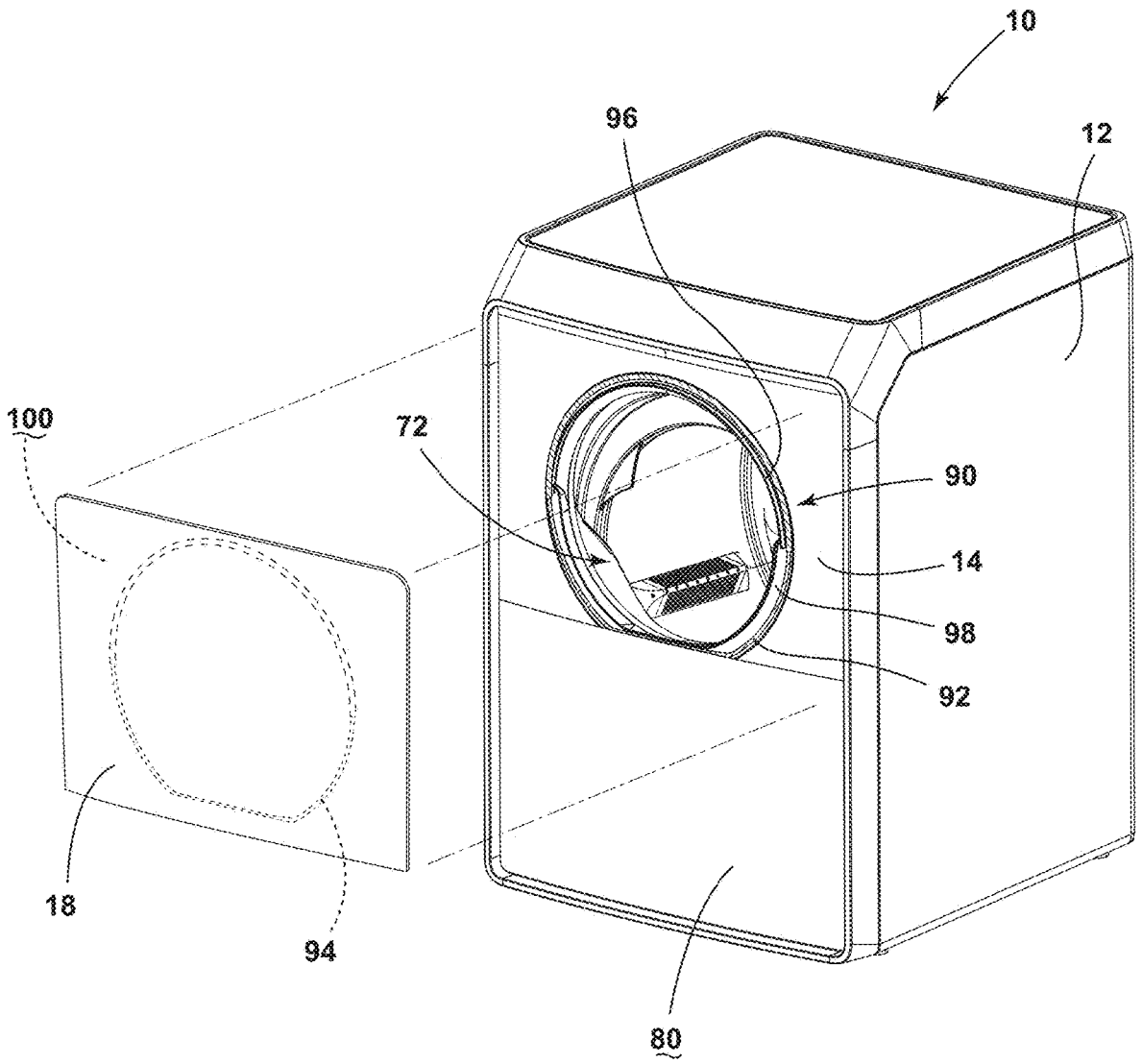
FIG. 7 is a side perspective partially exploded view of a laundry appliance with a seal assembly having a first seal on a cabinet and a second seal on a door, according to the present disclosure.
Figure 8:
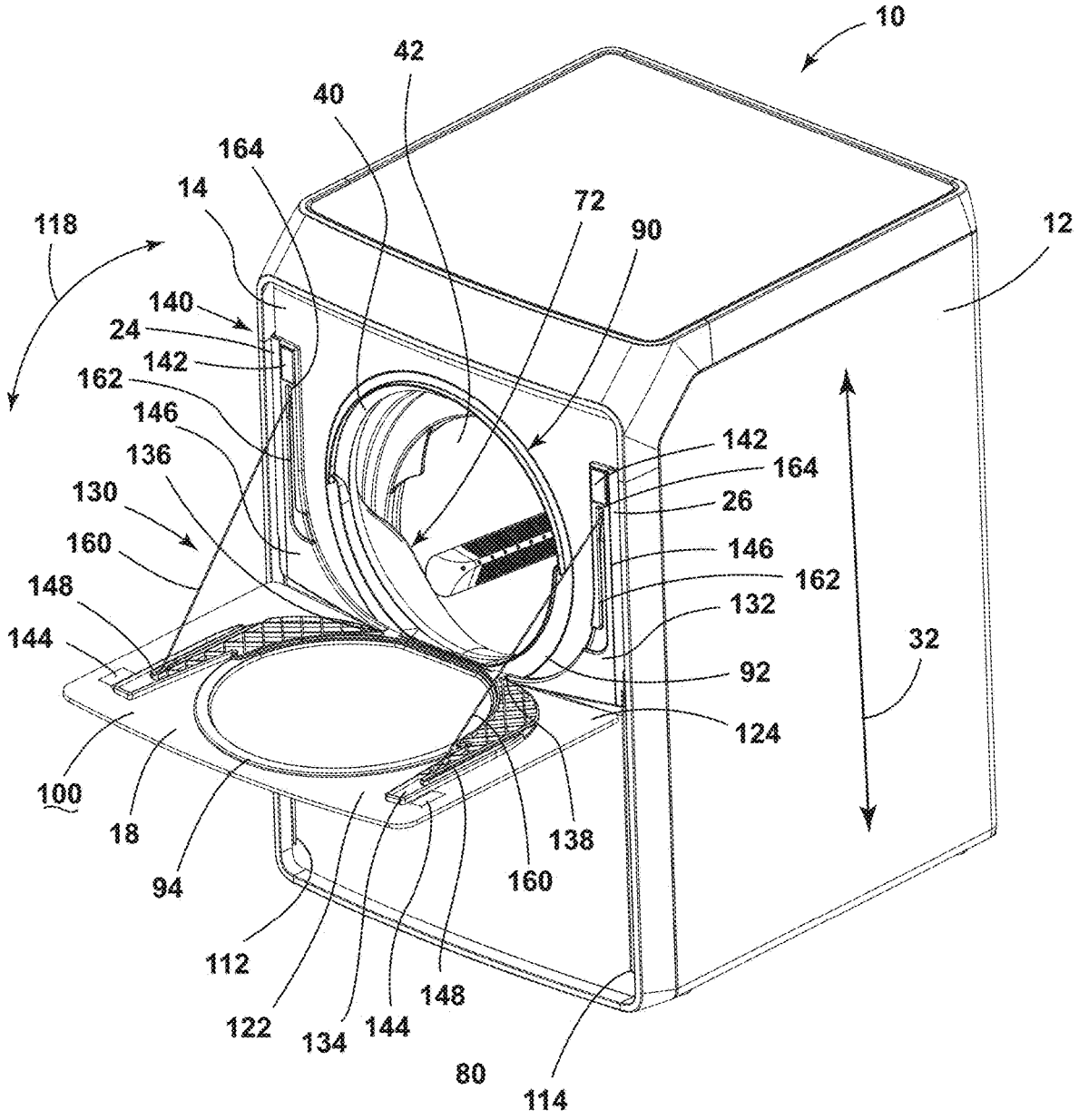
FIG. 8 is a side perspective view of a laundry appliance with a door in a deployed position at a first height, according to the present disclosure.

Referring still to FIG. 3, as well as FIGS. 7 and 8, the laundry appliance 10 includes a seal assembly 90 for providing a watertight seal between the door 18 and the cabinet 12 around the front opening 40. The seal assembly 90 may be utilized in combination with or independently of the deflector 72. It is contemplated that the addition of the deflector 72 does not substantially affect or impede the function of the seal assembly 90.

The seal assembly 90 includes a first seal 92 extending around the front opening 40. The first seal 92 may be coupled to the front panel 14 of the cabinet 12, the deflector 72, or a combination thereof. The first seal 92 generally has an angled front surface with respect to vertical for engaging the door 18 when in the closed position 20 and allowing movement of the door 18. The angled front surface may be from the angled seal 92 with a consistent thickness, or alternatively an upper portion 96 of the first seal 92 may have a different thickness than a lower portion 98.

Typically, the upper portion 96 is thicker than the lower portion 98. This configuration of the seal assembly 90 allows the second seal 94 on the door 18 to slide past the lower portion 98 of the first seal 92 without causing the frictional engagement. A top portion of the door 18 can bypass the thinner lower portion 98 of the first seal 92 during movement along the first movement path 32, while allowing a top portion of the second seal 94 and a bottom portion of second seal 94 to engage the upper and lower portions 96, 98 of the first seal 92 when the door 18 is in the closed position 20. The first seal 92 may be a single component extending around the entire perimeter of the front opening 40.

In various aspects, the first seal 92 may be two portions that are generally U-shaped, which each extend around about half of the front opening 40. The U-shaped seal 92 or the first seal 92 with different thicknesses, allows for the non-frictional or reduced-frictional vertical movement of the door 18. Additionally, these configurations of the first seal 92 provides a shape that results in a release of the door 18 from the first seal 92, allowing the rotational movement (e.g., "z" movement about axis a) as described herein.

The second seal 94 of the seal assembly 90 is coupled to an inner surface 100 of the door 18. The second seal 94 defines a shape and size to mate with the first seal 92 and provides the watertight seal. The second seal 94 may have a uniform thickness or a variable thickness that is configured to cooperate with the first seal 92. The configuration of the seal assembly 90 allows the door 18 to slide along the front surface 80 of the front panel 14 without causing incidental friction between the first seal 92 and the second seal 94.

When the first seal 92 has different thicknesses, the second seal 94 may also have different thicknesses to mate with the first seal 92. For example, when the lower portion 98 of the first seal 92 is thinner, a lower portion of the second seal 94 may be thicker to form the watertight seal. Additionally, the mating thicknesses of the first seal 92 and the second seal 94 provides an overall thickness of the seal assembly 90 that is consistent from top to bottom. The consistent thickness of the seal assembly 90 is advantageous for maintaining the door 18 parallel to the front surface 80 of the front panel 14. The parallel orientation may maximize efficiency of the door 18 during movement along the first movement path 32.

Referring still to FIGS. 3, 7, and 8, the seal assembly 90 is generally configured to reach a fully engaged condition as the door 18 reaches the fully closed position 20. By reaching the fully engaged condition when the door 18 is fully closed, friction between the first seal 92 and the second seal 94 is minimized. Minimizing the friction is advantageous for utilizing less energy to operate the motor 64 to move the door 18 and increase the longevity of the seal assembly 90.

Figure 9:
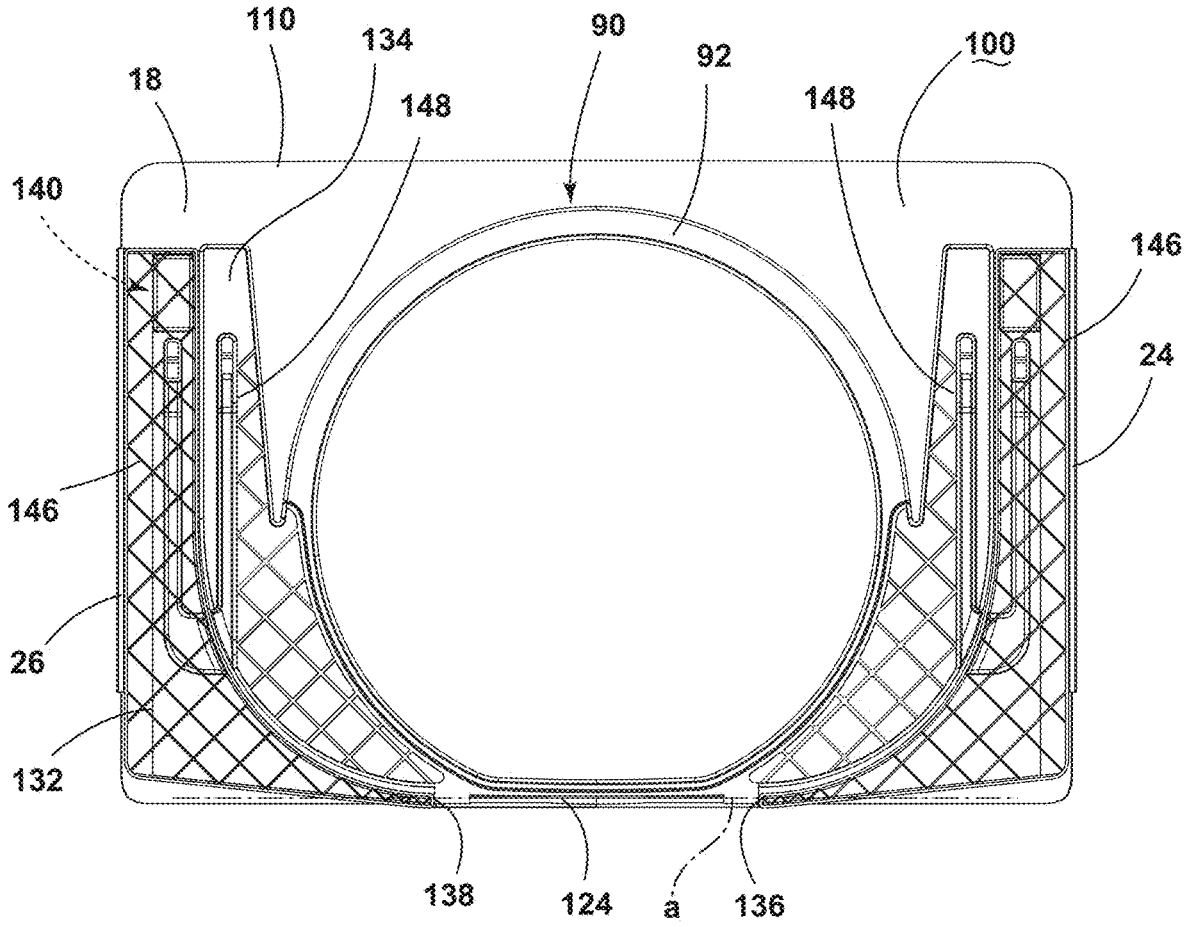
FIG. 9 is a rear elevational view of a door with a deploying assembly, according to the present disclosure.
Figure 10:
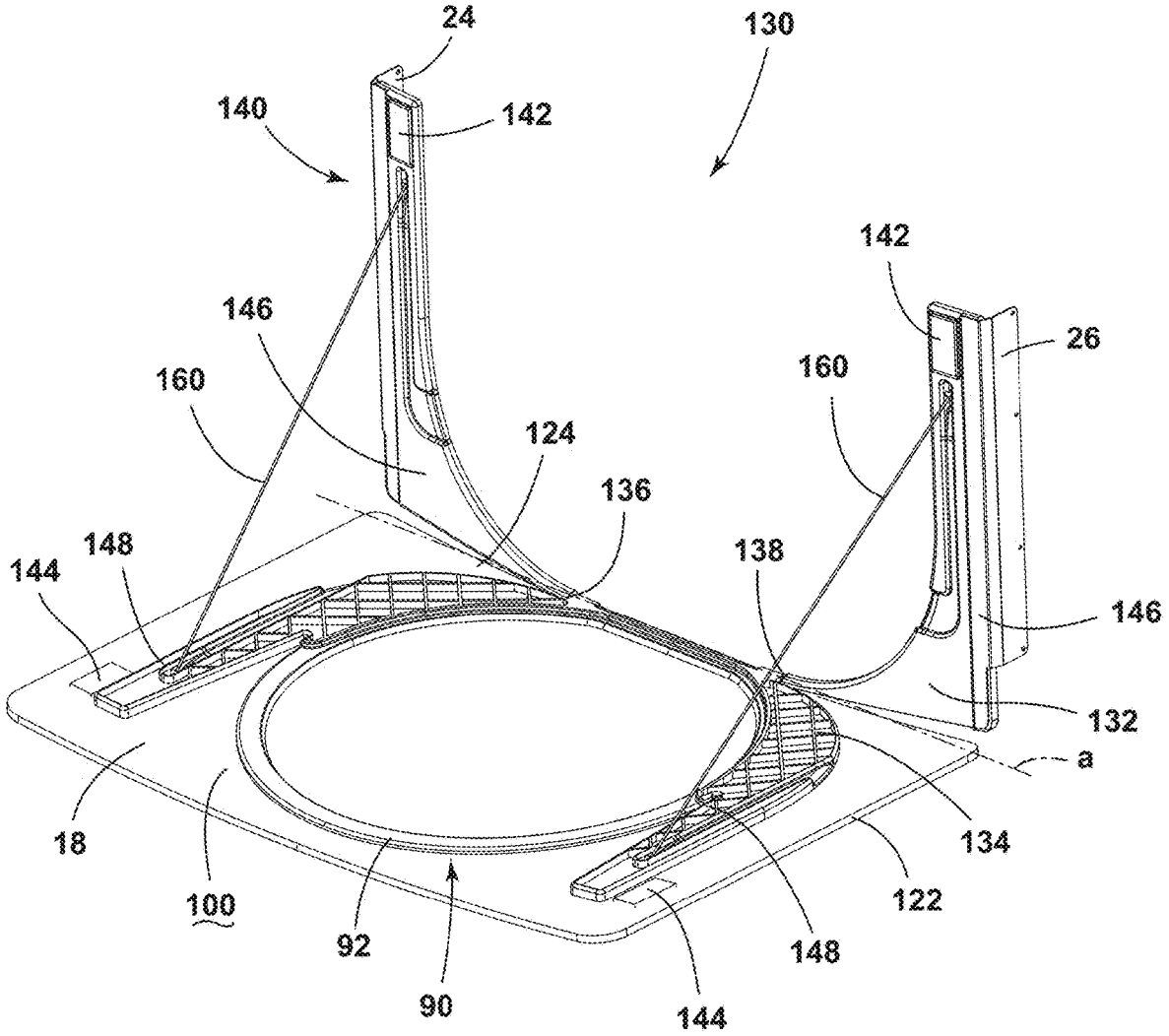
FIG. 10 is a side perspective view of a deploying assembly retaining a door in a deployed position, where the deploying assembly is removed from an appliance, according to the present disclosure.
Figure 11:
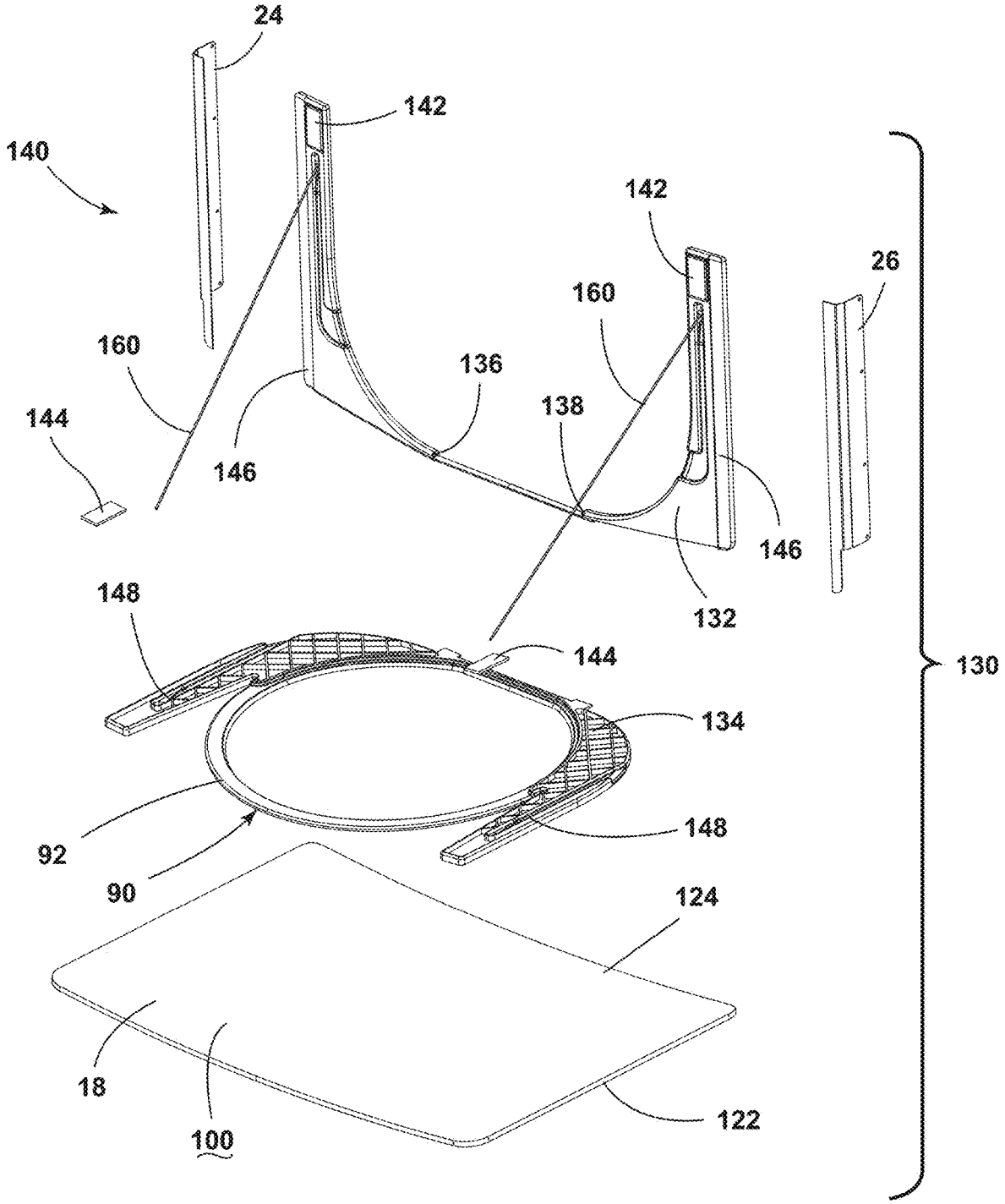
FIG. 11 is a side perspective exploded view of a deploying assembly and a door for an appliance, according to the present disclosure.

Referring still to FIG. 8, as well as FIGS. 9-11, the door is generally in a vertical or upright orientation 110 as the door 18 slides along the first movement path 32 between the closed and opened positions 20, 22. The brackets 24, 26 extend through tracks or slots 112, 114 defined at least partially by the front panel 14 to engage the rail assembly 16. The front panel 14 may fully define the slots 112, 114, or the slots 112, 114 may be defined between the front panel 14 and other panels of the cabinet 12. Bristles, gaskets, or other blocking features may extend into the slots 112, 114 to prevent or limit materials from entering the interior of the laundry appliance 10 while not substantially interfering with the movement of the brackets 24, 26. Accordingly, when moving along the first movement path 32 between the closed and opened positions 20, 22, the door 18 remains adjacent to the front surface 80 of the front panel 14.

The door 18 is also configured to move along a second movement path 118 between the upright orientation 110 and a deployed position 122. In the deployed position 122, the top edge 48 of the door 18 is rotated away from the front panel 14 of the cabinet 12, while a bottom edge 124 of the door 18 remains adjacent to the front panel 14. The door 18 rotates about a generally horizontal rotational axis a to reach the deployed position 122 in response to a predetermined force acting on the door 18. When in the deployed position 122, the door 18 extends at least perpendicularly to the front panel 14 of the cabinet 12.

According to various aspects, the laundry appliance 10 includes a deploying assembly 130, which is configured to retain the door 18 in the upright orientation 110 and the deployed position 122. The deploying assembly 130 includes a first frame 132 coupled to the cabinet 12 and a second frame 134 coupled to the inner surface 100 of the door 18. The first frame 132 has a generally U-shaped construction to extend around the front opening 40 without substantially interfering with the front opening 40. Accordingly, the first frame 132 extends along the front surface 80 of the front panel 14 and under the front opening 40 without substantially impeding the front opening 40. The first frame 132 is coupled to the brackets 24, 26, allowing the first frame 132, and consequently, the deploying assembly 130, to translate vertically between the closed and opened positions 20, 22.

In certain aspects, the first frame 132 may be formed of two separate side portions. In such examples, one side portion is coupled to one bracket 24 and the other side portion is coupled to the other bracket 26. The side portions of the first frame 132 are disposed on opposing sides of the front opening 40 without extending below the front opening 40 to couple with one another.

Referring still to FIGS. 8-11, the second frame 134 has a generally U-shaped construction, which is smaller than the U-shaped construction of the first frame 132. As best illustrated in FIG. 9, when the door 18 is in the upright orientation 110, the second frame 134 fits inside the first frame 132. The second frame 134 is rotatably coupled to the first frame 132. Pivot points 136, 138 are defined between the first frame 132 and the second frame 134 proximate to the bottom edge 124 of the door 18 providing a hinge for the rotational movement of the door 18 to the deployed position 122. In the illustrated configuration when the door 18 is disposed over the front opening 40, the pivot points 136, 138 are disposed proximate to the bottom edge 50 of the front opening 40. The rotational engagement allows the door 18 to rotate toward the deployed position 122. The door 18 may be coupled to the cabinet 12 via the deploying assembly 130.

In configurations with the deploying assembly 130, the seal assembly 90 is adjusted. The second seal 94 is generally coupled to or integral with the second frame 134. The second seal 94 is coupled to the inner surface 100 of the door 18 and the second frame 134. The second seal 94 extends along an inner edge of the second frame 134 and forms the shape to mate with the first seal 92 as described herein.

Referring still to FIGS. 8-11, the deploying assembly 130 retains the door 18 in both the upright orientation 110 and the deployed position 122. The deploying assembly 130 includes a latch assembly 140 to retain the door 18 in the upright orientation 110. The latch assembly 140 includes first latch features 142 coupled to the first frame 132 and that are configured to engage the second latch features 144, which are coupled to at least one of the second frame 134 and the inner surface 100 of the door 18.

Generally, the latch assembly 140 includes two first latch features 142 with one latch feature 142 positioned at a top of each upright 146 of the U-shaped first frame 132. The latch assembly 140 also includes two second latch features 144, which are generally disposed adjacent to extensions 148 of the U-shaped second frame 134. The latch features 142, 144 are mating features, which engage when the door 18 is rotated to the upright orientation 110. The latch features 142, 144 may be magnets, push-push connectors, snap features, hook and loop fasteners, or other coupling features that are selectively and repeatably engageable with one another.

The deploying assembly 130 also retains the door 18 in the deployed position 122. When the door 18 is in the deployed position 122, the door 18 extends generally horizontally or perpendicular to the front panel 14. Accordingly, the door 18 generally rotates about 90° from the upright orientation 110 to the deployed position 122. The deploying assembly 130 includes support features 160 extending between the first and second frames 132, 134 to support and retain the door 18 and the deployed position 122.

The support features 160 may be cables, tethers, arms, telescoping members, or other similar support members that have minimal elasticity. The support features 160 are generally flexible, retractable, or otherwise movable, such that the support features 160 do not substantially impinge the movement of the door 18 or the retention of the door 18 in the upright orientation 110. For example, the support features 160 may fold between the first frame 132 and the second frame 134, be retracted into a pocket, retracted into a nested state, etc.

Figure 12:
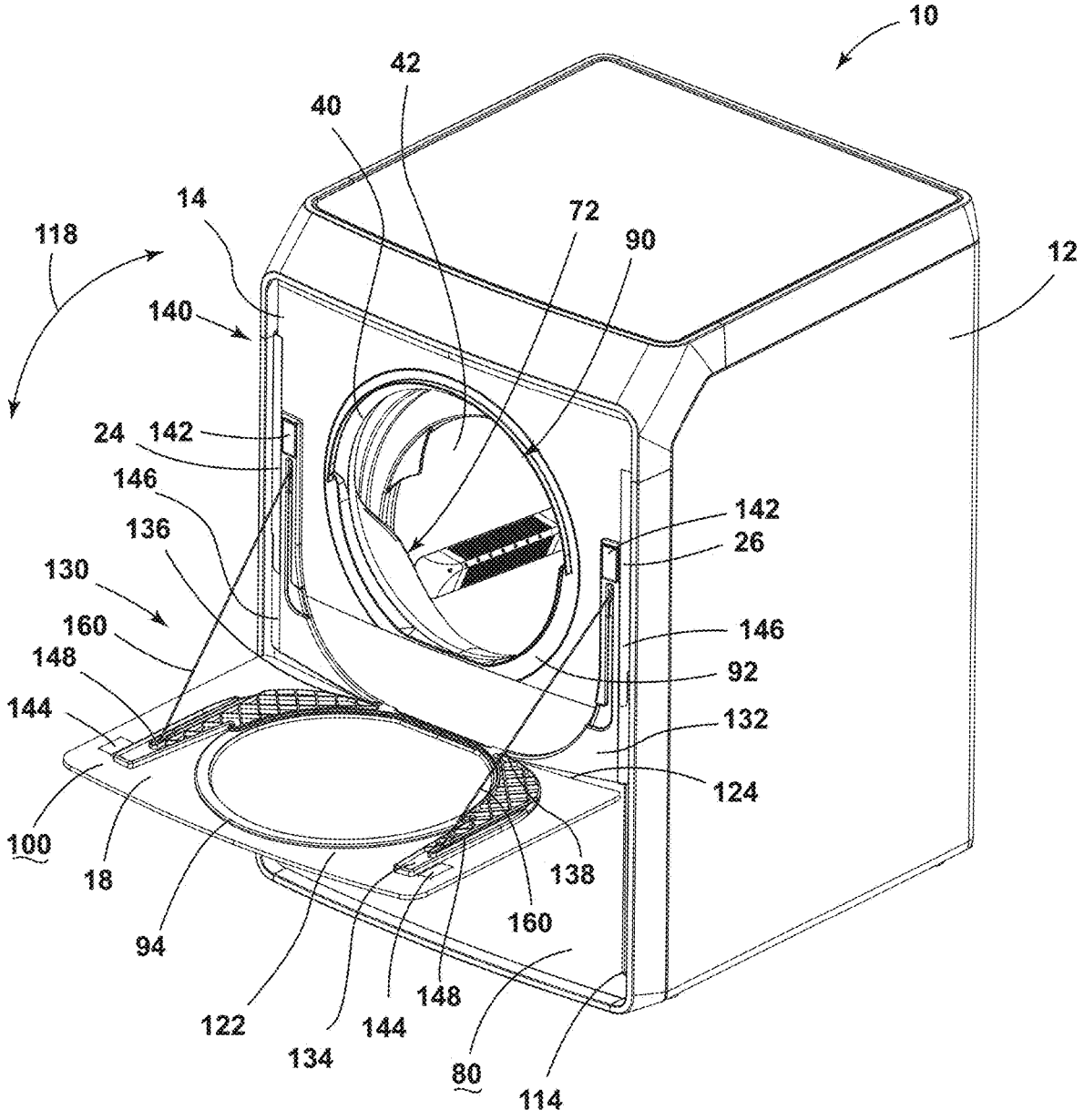
FIG. 12 is a side perspective view of a laundry appliance with a door in a deployed position at a second height, according to the present disclosure.

Referring still to FIG. 8, as well as FIG. 12, the first frame 132 is coupled to the brackets 24, 26, which engage the rail assembly 16. Accordingly, the deploying assembly 130 translates vertically along the rail assembly 16. The entire deploying assembly 130 and the door 18 are translated vertically via the rail assembly 16. This translating configuration of the deploying assembly 130 allows the door 18 to be rotated to the deployed position 122 at any vertical height between the opened position 22 and the closed position 20 as the deploying assembly 130 travels vertically with the door 18.

Figure 13:
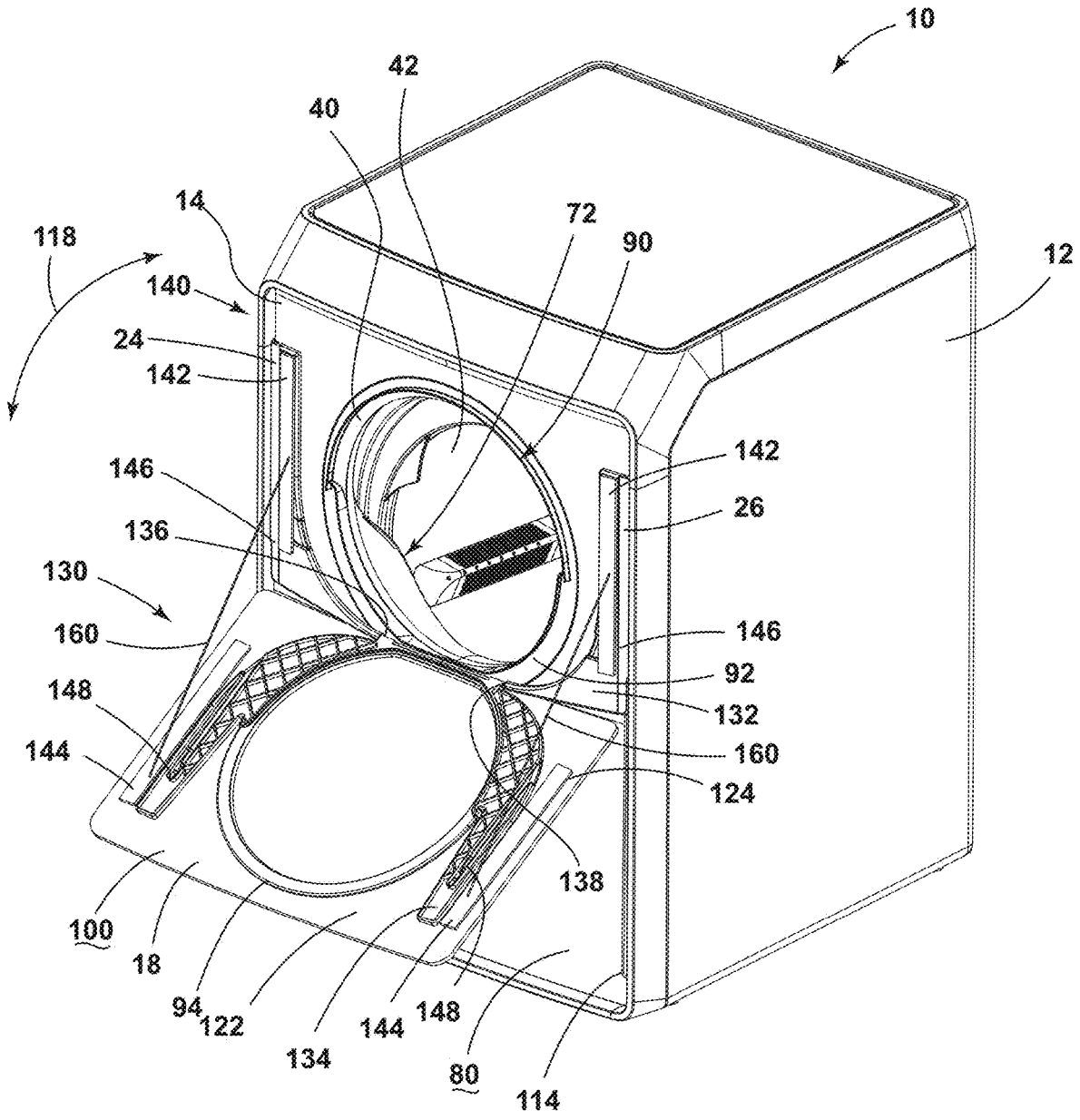
FIG. 13 is a side perspective view of a laundry appliance with elongated latch features and a door in a deployed position, according to the present disclosure.

Referring to FIGS. 8 and 13, in certain aspects, the door 18 is configured to rotate greater than 90° to the deployed position 122. As illustrated in FIG. 8, the first frame 132 defines tracks 162 on the uprights 146. The support features 160 are coupled to slides 164 that can translate along the tracks 162. The slides 164 are generally manually moveable. Alternatively, the slides 164 may be coupled with an additional motor or actuator to automatically adjust the rotation of the door 18. The slides 164 allow the location where the support features 160 are coupled to the first frame 132 to be adjusted. The lowering of the slides 164 along the tracks 162 allows the door 18 to be opened to greater angles. Typically, when the slides 164 are positioned proximate top, closed ends of the tracks 162, the door 18 can be rotated about 90° relative to the front panel 14. The closed ends of the tracks 162 may also correspond to smaller opening angles of the door 18, such as those used for venting the laundry appliance 10, without departing from the teachings herein. The slides 164 may include locking features configured to lock the slides 164 at a select location along the tracks 162, maintaining the door 18 at the select angle in the deployed position 122.

The tracks 162 also have a bottom, open end. In various aspects, the slides 164 may be moved along the tracks 162 and past the open ends to disengage the slides 164 from the first frame 132. This may be advantageous for being able to rotate the door 18 through an angle of about 180° where an outer surface of the door 18 is adjacent to the front panel 14. This degree of rotation may be advantageous for cleaning, maintenance, etc. It is also contemplated that the second frame 134 may also include the tracks 162 and the slides 164 for adjusting the connection point between the support features 160 and the second frame 134.

As illustrated in FIG. 13, the attachment location between the support features 160 and the first frame 132 may be static and may be at a location that provides for a greater degree of rotation of the door 18. For example, in FIG. 13, the support features 160 are coupled to the first frame 132 at a mid-point of the uprights 146. This lower connection point, compared to the top ends of the uprights 146 in FIG. 8, allows for greater rotation of the door 18 through an angle beyond 90°.

Further, in the illustrated example of FIG. 13, the latch assembly 140 has elongated latch features 142, 144. The first latch features 142 extend vertically along the front panel 14 on opposing sides of the front opening 40. The second latch features 144 extend along the inner surface 100 of the door 18. The first latch features 142 may be coupled to the first frame 132, or alternatively may be coupled to the brackets 24, 26 to translate vertically and allow the door to adjust to the deployed position 122 at any vertical height. The pivot points 136, 138 may be defined between the first frame 132 and the second frame 134, or alternatively between the latch features 142, 144 to allow the door 18 to rotate. The elongated latch features 142, 144 may provide greater surface area for engaging the latch features 142, 144 with one another, securing the retention of the door 18 in the upright orientation 110.

Figure 14:
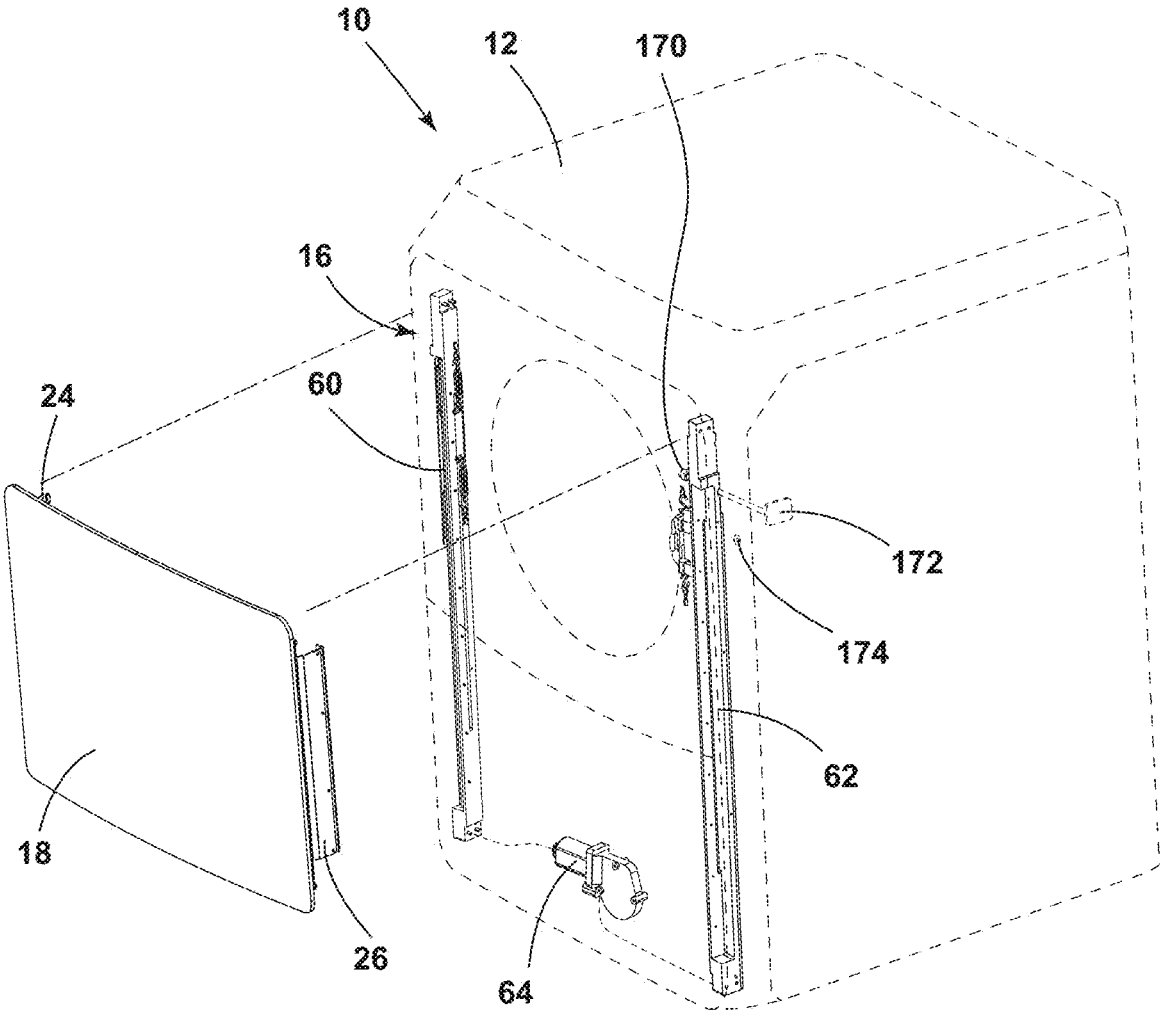
FIG. 14 is a side perspective partial exploded view of a laundry appliance where a door is configured to be disengaged from a motor of a rail assembly, according to the present disclosure.

Referring to FIG. 14, it is contemplated that the brackets 24, 26 may be disengaged from the motorized aspect of the rail assembly 16. Upon disengagement, the door 18 can be manually adjusted between the closed and opened positions 20, 22. The rail assembly 16 includes a coupling feature 170, which retains engagement between the brackets 24, 26 and the rail assembly 16. The coupling feature 170 may be, for example, a pin that may be adjusted to engage or disengage the brackets 24, 26 or a portion of the rail assembly 16. The laundry appliance 10 includes a button 172 or other actuating feature, which moves the coupling feature 170 to disengage one or both of the brackets 24, 26 or a portion of the rail assembly 16 or the motor 64. The button 172 can also disengage the motor 64 or idle the motor 64 so the rails 60, 62, the brackets 24, 26, and the door 18 operate generally freely.

Manual adjustment of the door 18 may be advantageous in the event of a power outage, when the motor 64 should be replaced, or for user preferences. When the user wants to manually adjust the door 18, the user can press the button 172, which adjusts the coupling feature 170 to disengage the brackets 24, 26 from the motorized aspect of the rail assembly 16. The user can then manually adjust the position of the door 18. The laundry appliance 10 uses the linear counterbalancing springs to allow manual raising and lowering of the door 18 with a more lightweight feeling for the user for more convenient movement. Further, the counterbalancing springs assist the motor 64 in adjusting the door 18 with less power when the door 18 is connected to the motor 64.

The laundry appliance 10 can include a visual marker 174. The visual marker 174 typically indicates a height in which the door 18 can be reengaged with the motorized aspect of the rail assembly 16. The visual marker 174 is typically in a fixed location. It is contemplated that the visual marker 174 is substantially obscured by the door when the door 18 is in the closed position 20. In certain aspects, the visual marker 174 may be a light or other adjustable feature that is visible when the door 18 is disengaged from the motor 64 and substantially obscured when the door 18 is engaged with the motor 64. The visual marker 174 is generally advantageous for allowing the user to realign the door 18 with the coupling feature 170 to reengage the brackets 24, 26 with the motor 64 of the rail assembly 16.

In certain aspects, the brackets 24, 26 may physically disengage from the rails 60, 62. This configuration may be advantageous when the brackets 24, 26 are fixed to the door 18 and the door 18 rotates to the deployed position 122. In such examples, the visual marker 174 indicates a position of the door 18 in which the brackets 24, 26 can reengage the rails 60, 62.

Figure 15:
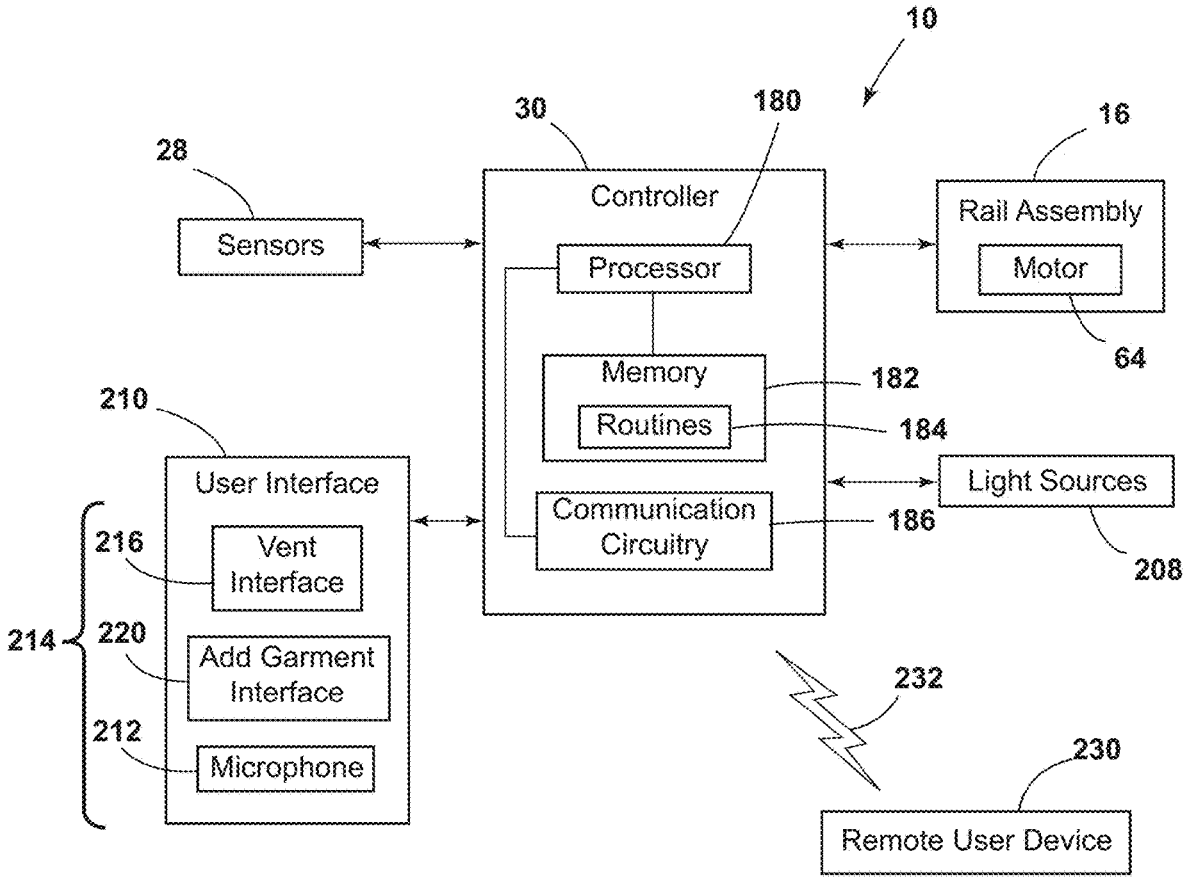
FIG. 15 is a block diagram of a laundry appliance, according to the present disclosure.

Referring to FIG. 15, as well as FIGS. 1-14, the laundry appliance 10 includes the controller 30, which has a processor 180, a memory 182, and other control circuitry. Instructions or routines 184 are stored within the memory 182 and are executable by the processor 180. The control circuitry generally includes communication circuitry 186 for multi-directional communication. The controller 30 disclosed herein may include various types of control circuitry, digital or analog, and may each include the processor 180, a microcontroller, an application specific circuit (ASIC), or other circuitry configured to perform the various input or output, control, analysis, or other functions described herein. The memory 182 described herein may be implemented in a variety of volatile and nonvolatile memory formats. The routines 184 include operating instructions to enable various methods and functions described herein.

The controller 30 is communicatively coupled with the sensors 28. The sensors 28 may be, for example, touchless infrared sensors 28 having a collective field of view 190 that extends outward from the front panel 14 and/or the door 18 of the laundry appliance 10. It is also contemplated that the sensors 28 may be touch sensors, capacitive sensors, proximity sensors, laser time-of-flight sensors, or other touchless sensing devices. Generally, the laundry appliance 10 includes multiple sensors 28 arranged along a top edge 192 of the front panel 14 above the front opening 40. Additionally or alternatively, the sensors 28 may be arranged on the door 18. The door 18 sliding along the front surface 80 may be advantageous for positioning the sensors 28 on the door 18 as the field of view 190 may not be obstructed by the front panel 14. It is contemplated that the sensors 28 may be disposed elsewhere on the laundry appliance 10 without departing from the teachings herein.

The controller 30 is generally configured to adjust the door 18 along the first movement path 32 when the sensors 28 sense a triggering event within the field of view 190. The triggering event may be a presence of the user, a gesture, etc. For example, the user can swipe his or her hand from left to right within the field of view 190, which may be the triggering event that causes activation of the door 18. Upon sensing the triggering event, the sensors 28 communicate a signal to the controller 30, which then activates the motor 64 to adjust the door 18 along the rail assembly 16.

The specific movement along the first movement path 32 generally depends on at least one of the triggering event and a current position of the door 18. For example, when the door 18 is in the closed position 20, the door 18 typically moves vertically down along a first direction 194 along the first movement path 32 to the opened position 22. Similarly, when the door 18 is in the opened position 22 and the triggering event is sensed, the door 18 moves in a second direction 196 along the first movement path 32 from the opened position 22 to the closed position 20. In such examples, a single triggering causes an express opening or express closing, where the door 18 moves fully between the opened position 22 and the closed position 20.

It is contemplated that different triggering events can be used for different movements of the door 18. Some triggering events may cause the door 18 to partially open, partially close, be stopped at the current position, etc. In certain aspects, a first triggering event can start movement of the door 18 and a second triggering event can stop the movement of the door 18 at the current position.

Referring still to FIGS. 1-15, the controller 30 is configured to automatically adjust the door 18 when the door 18 encounters the obstruction or object 34 along one of the first and second directions 194, 196 through the first movement path 32. As the door 18 is traveling vertically, the door 18 may encounter an obstruction or object 34 that prevents or hinders continued movement. For example, the object 34 could prevent movement in the first direction 194 when the bottom edge 124 of the door 18 encounters the object 34 or in the second direction 196 when the top edge 48 of the door 18 encounters the object 34. The controller 30 is configured to automatically adjust the movement of the door upon detection of the object 34 affecting the movement of the door 18. For example, the controller 30 can adjust the door 18 from moving through the first movement path 32 in the first direction 194 to the second direction 196 when the door 18 encounters the object 34 while moving in the first direction 194.

The type of automatic adjustment of the movement of the door 18 may depend on the type of object 34, the number of objects 34, user preferences, etc. For example, when the object 34 is detected in when moving in the first direction 194 (e.g., opening), the door 18 may automatically be adjusted to the closed position 20. If a second object 34 is detected in when moving in the second direction 196 (e.g., closing), the door 18 may then pause movement. The controller 30 can adjust the door 18 to the fully opened position 22 or the fully closed position 20. Alternatively, the controller 30 can adjust the door a predetermined distance (e.g., a few inches) in an opposing direction and then stop movement on the door 18. In this way, the controller 30 can operate the door 18 to a full retreat from the object 34, a partial retreat from the object 34, a complete stop, or other user-defined movements. The automatic adjustment is advantageous for allowing the removal of the object 34.

The laundry appliance 10 may also have at least one light source 208 for illuminating the drum 42. The light sources 208 are generally positioned on the bellows 70, as illustrated in FIG. 6. The light sources 208 can activate in response to the sensors 28 sensing the user or a triggering event or through an input in a user interface 210. The light sources 208 are advantageous for providing greater visibility into the drum 42.

In various examples, the light sources 208 emits visible light that has a wavelength in a range of from about 380 nm to about 740 nm, or a mix of wavelengths in this range. The light sources 208 may include, but is not limited to, any form of light source 208, for example, fluorescent lighting, light emitting diodes (LEDs) (including organic LEDs (OLEDs), polymer LEDs (PLEDs), laser diodes, quantum dot LEDs (QD-LEDs) and other similar diode-based lighting), solid-state lighting, a hybrid, and/or any other similar illumination device. Any other form of lighting may be utilized within the laundry appliance 10 without departing from the teachings herein. Further, various types of LEDs are suitable for use as the light sources 208, including, but not limited to, top-emitting LEDs, side-emitting LEDs, and others. According to various examples, multicolored light sources, such as Red, Green, and Blue (RGB) LEDs that employ red, green, and blue LED packaging may be used to generate various desired colors of light output from a single light source 208, according to known light color mixing techniques. Moreover, the light sources 208 may be configured as a single light source 208, or alternatively, as more than one light source 208 that can be selectively and independently controlled.

Figure 16:
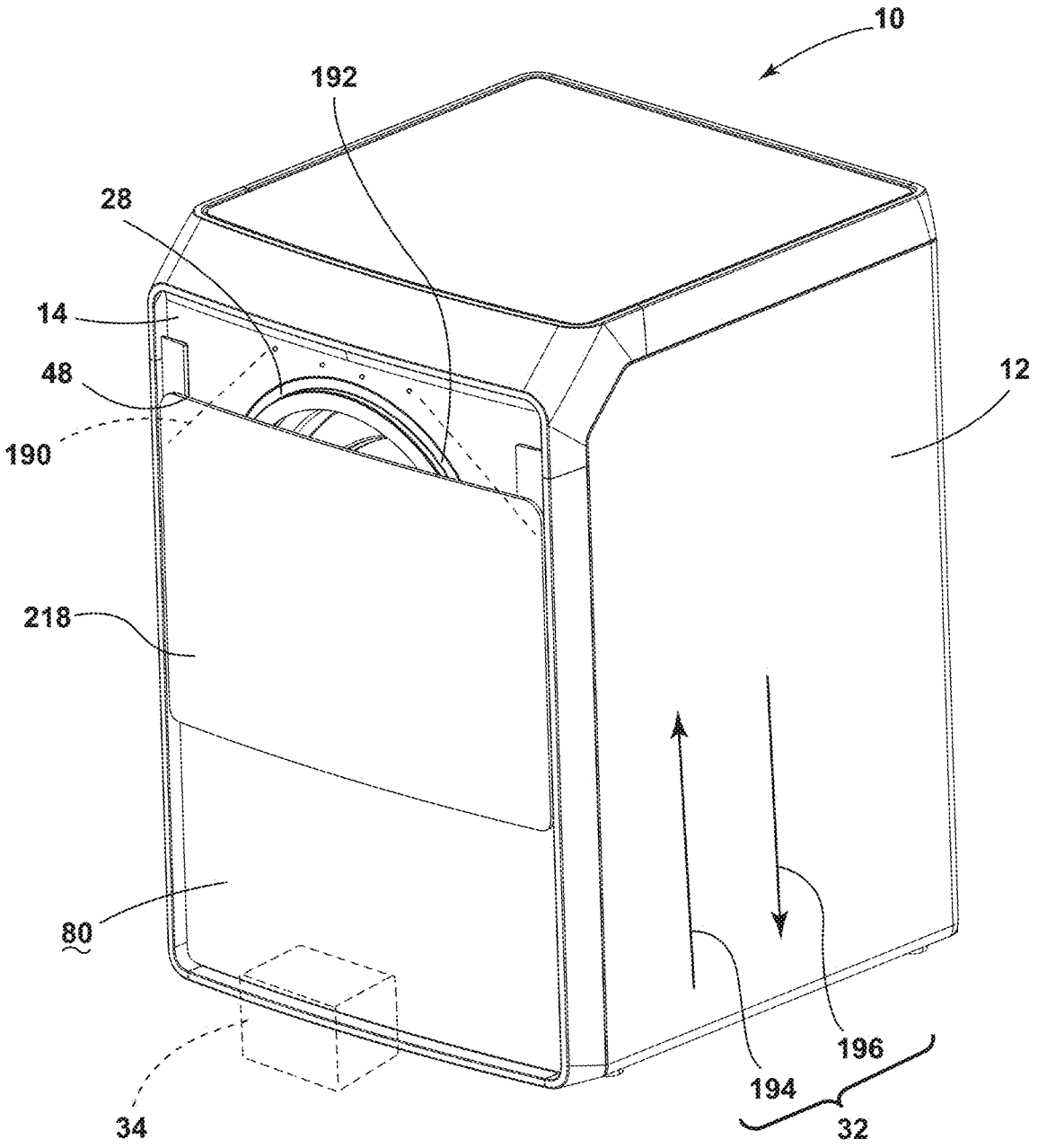
FIG. 16 is a side perspective view of a laundry appliance with a door in a venting position, according to the present disclosure.
Figure 17:
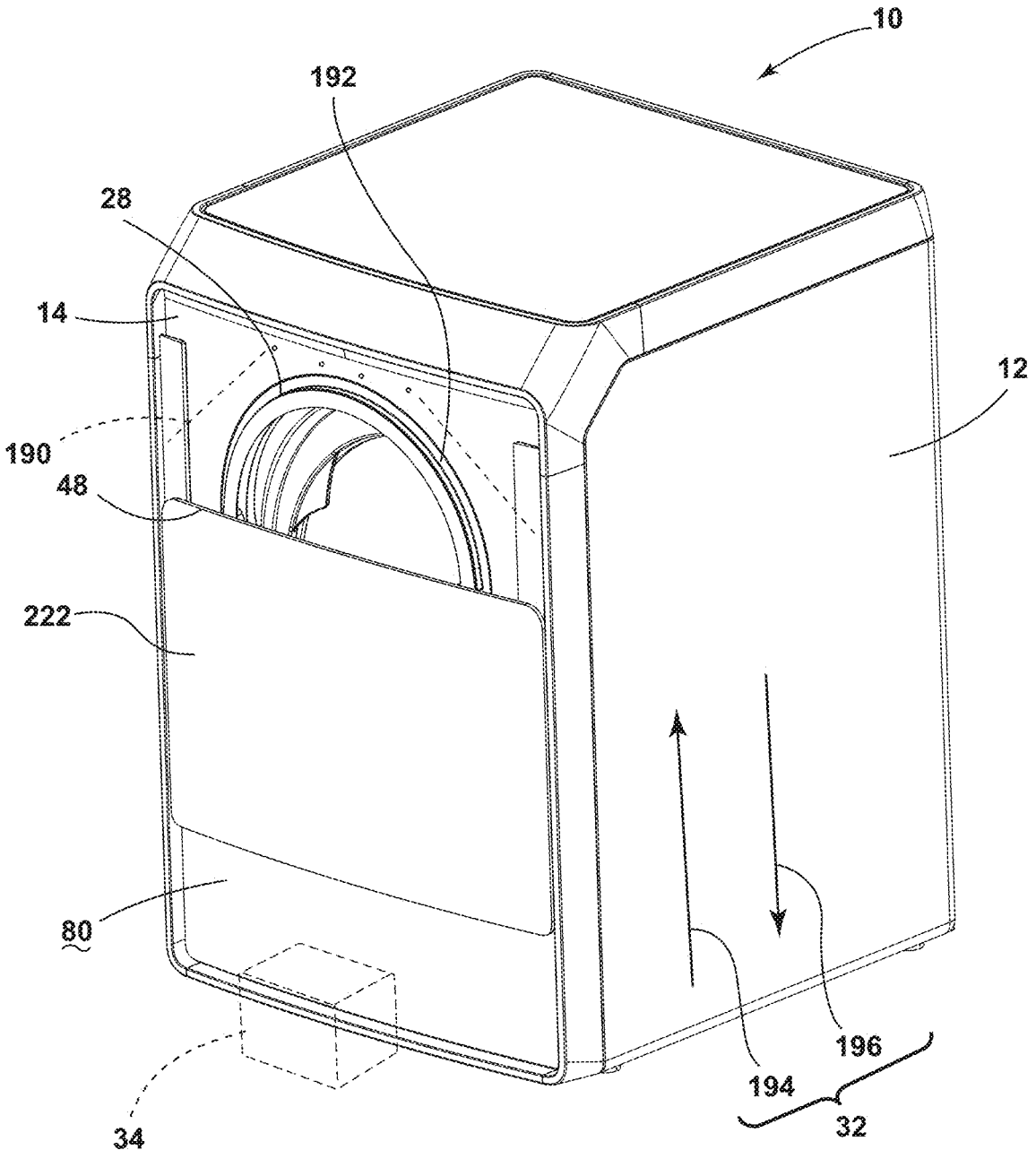
FIG. 17 is a side perspective view of a laundry appliance with a door in an add garment position, according to the present disclosure.

Referring still to FIG. 15, as well as FIGS. 16 and 17, the controller 30 is communicatively coupled with the user interface 210. The user interface 210 may include a microphone 212 for receiving voice commands. The user can use a voice command as the triggering event to control the movement of the door 18.

The user interface 210 also includes buttons or other selectable features 214 relating to predefined operation settings of the door 18. For example, one of the selectable features 214 can be an automatic venting interface 216. When the automatic venting interface 216 is selected, the controller 30 is configured to automatically adjust the door 18 to a venting position 218. Typically, the automatic adjustment to the venting position 218 occurs upon completion of a laundry cycle.

As illustrated in FIG. 16, the venting position 218 is a partially open position that allows airflow into the drum 42. The venting position 218 is advantageous to allow airflow into the drum 42 and around laundry therein. Additionally, the venting position 218 may be advantageous for when the user is not readily available to remove the laundry from the laundry appliance 10 upon completion of the laundry cycle.

Additionally or alternatively, one of the selectable features 214 may be an add garment interface 220. The user can select the add garment interface 220 during the laundry cycle. Generally, once the laundry cycle is started, the controller 30 prevents the door 18 from opening (e.g., the door 18 is locked in the closed position 20). In such examples, even when the triggering event is sensed by the sensors 28, the door 18 remains closed.

When the user selects the add garment interface 220, the controller 30 is configured to pause the laundry cycle and adjust the door 18 to an add garment position 222. The add garment position 222 is advantageous for adding laundry to the drum 42 without fully opening the door 18 and can typically be done after the start of the laundry cycle. After adding the laundry, the user can again select the add garment interface 220 or provide the triggering event to close the door 18 and reinitiate the laundry cycle. The add garment position 222 is generally a partially open position. The add garment position 222 may be a sufficiently open position to allow the user to add the laundry or garments into the drum 42. The door 18 is typically opened more when in the add garment position 222 compared to the venting position 218. Additional partially open positions and other selectable features 214 may be included in the laundry appliance 10 without departing from the teachings herein.

Referring again to FIG. 15, a remote user device 230 may be communicatively coupled to the controller 30. The remote user device 230 is generally configured to receive a user input relating to operation of the door 18 and operation of the laundry appliance 10. The remote user device 230 can also be utilized for monitoring various aspects of the door 18 or laundry appliance 10. The remote user device 230 provides a remote interface for communicating with the laundry appliance 10. The remote user device 230 can be any portable device, such as a phone, a tablet, a computer, a virtual assistant device, a wearable device, or other similar devices.

The controller 30 includes the communication circuitry 186 configured for bidirectional communication with the remote user device 230. The controller 30 communicates with the remote user device 230 and or remote servers (e.g., cloud servers, Internet connected databases, computers, etc.) via a communication interface 232. The communication interface 232 may be a network having one or more various wired or wireless communication mechanisms, including any combination of wired (e.g., cable and fiber) or wireless communications and any network topology or topologies. Exemplary communication networks include wireless communication networks such as, for example, Bluetooth®, Bluetooth® low-energy (BLE), Thread, Ultra-Wideband, Z-Wave, ZigBee, etc.

The communication interface 232 may be flexibly implemented such that the various devices and servers may communicate with one another directly via the wireless communication interface 232 or cellular data connection. Additional exemplary communication networks include local area networks (LAN) and/or wide area networks (WAN), including the Internet and other data communications services. It is contemplated that the controller 30 and the remote user device 230 each include circuitry for multidirectional wireless communication and can communicate by any suitable technology for exchanging data. Additionally, in examples using Bluetooth® devices, the remote user device 230 can be linked or synchronized (e.g., synced) with one or more laundry appliances 10 or other appliances to create a centralized home system.

Figure 18:
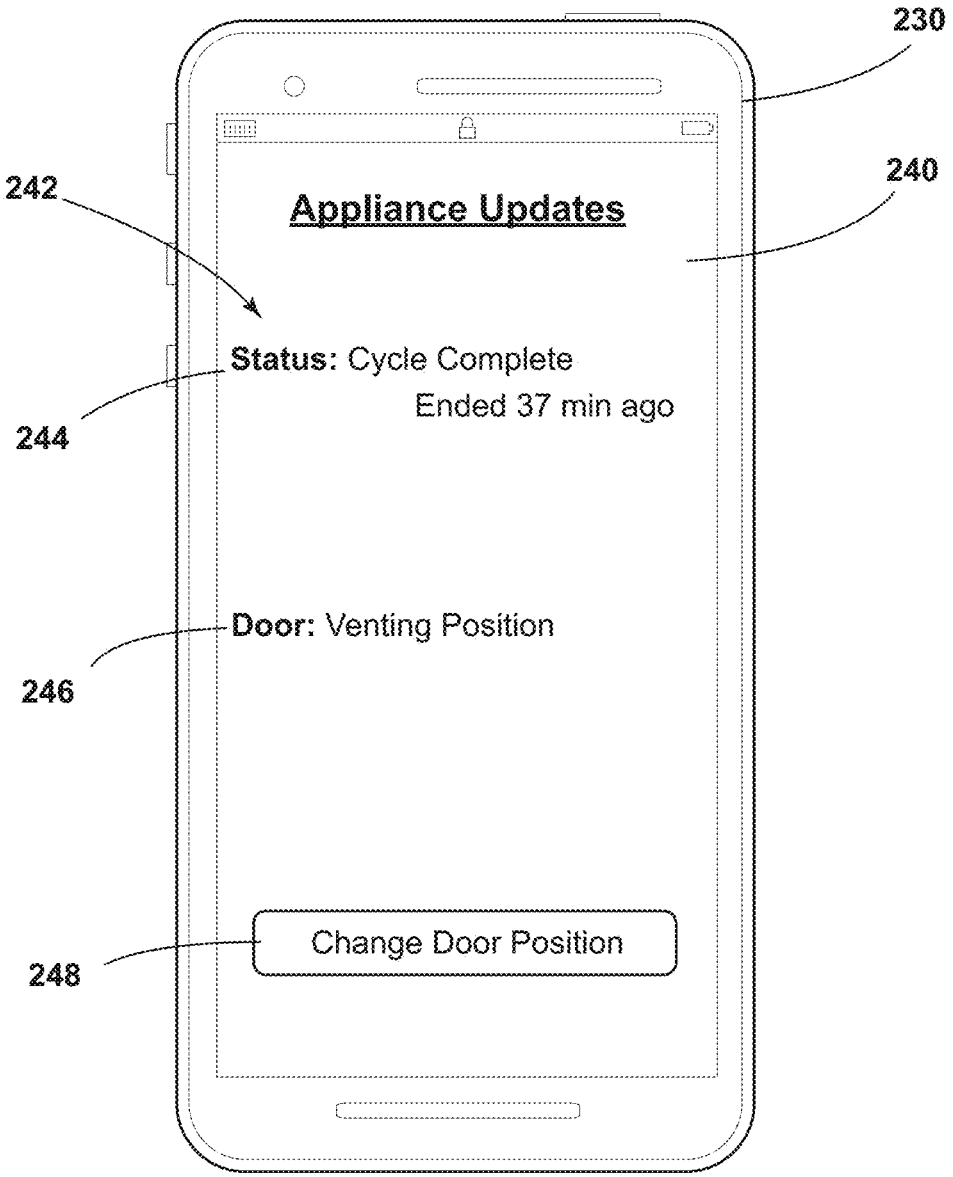
FIG. 18 is illustrative of an application interface of a remote user device displaying a notification about an appliance, according to the present disclosure.

Referring still to FIG. 15, as well as FIG. 18, the remote user device 230 includes an application interface 240 to display or otherwise communicate information about the laundry appliance 10 to the user. The remote user device 230 typically includes an application or software utilized for receiving information from the laundry appliance 10 and displaying the application interface 240. The controller 30 is generally configured to generate a notification 242 and communicate the notification 242 to the remote user device 230 to be displayed on application interface 240.

In the illustrated example, the notification 242 includes appliance information 244, as well as door information 246. The appliance information 244 includes a status of the completion of the laundry cycle and timing for the completion. The door information 246 includes the current position of the door 18. Other information about the laundry appliance 10 and the door 18 can be included in the notification 242 without departing from the teachings herein. Further, the notification 242 may be visual, haptic, or audible without departing from the teachings herein.

The application interface 240 may also include control features 248 that allow the user to remotely control the laundry appliance 10. The control features 248 allow the user to remotely change the position of the door 18. For example, if the automatic venting interface 216 was not previously activated by the user, the user can utilize the control features 248 to remotely adjust the door 18 to the venting position 218. It contemplated that the remote user device 230 may display or convey a variety of notifications 242 and other information that may be changed based on user preferences, user selections, etc.

Referring to FIGS. 1-18, in operation, the door 18 is typically motorized to provide automatic movement between the closed position 20 and the opened position 22 while also allowing manual adjustment to the deployed position 122 at any vertical height. The door 18 is activated by a triggering event received by the sensors 28, the microphone 212, the remote user device 230, a predefined selection of one of the selectable features 214, or combinations thereof. The triggering event causes activation of the motor 64 of the rail assembly 16. Based on the triggering event and/or the current position of the door 18, the controller 30 adjusts the door 18 along the first movement path 32 in the first direction 194 or the second direction 196. The user can pause the movement of the door 18 at any position between the closed position 20 and the opened position 22 in response to the type of triggering event or a subsequent triggering event.

The user can also rotate the door 18 to the deployed position 122. Generally, the deploying assembly 130 is coupled to the brackets 24, 26 that engaged the rail assembly 16. In this way, the deploying assembly 130 extends along the front surface 80 of the front panel 14 and adjusts with the door 18 along the first movement path 32. This allows the door 18 to be adjusted to the deployed position 122 at any vertical height. Further, when adjusting between the closed position 20 and opened position 22, the door 18 travels along the front surface 80 of the front panel 14. This configuration also allows flexibility for adjusting the door 18 to the deployed position 122 since the door 18 does not move into any pocket or internal cavity of the laundry appliance 10.

The user may apply a predefined force to the door 18, which may be a pushing or pulling force to rotate the door 18. The predefined force is sufficient to disengage the second latch features 144 on the door 18 from the first latch features 142 on the first frame 132. The door 18 then rotates about 90° to a generally horizontal position, or greater depending on the configuration of the deploying assembly 130, and is retained in the deployed position 122 by the support features 160. The door 18 in the deployed position 122 may be advantageous for increasing access to the interior of the drum 42, cleaning the inner surface 100 of the door 18, or providing access for a service technician.

The door 18 may be translated along the rails 60 while the door 18 is in the deployed position 122. The translation of the door 18 when in the deployed position 122 may be controlled as described herein with respect to the door 18 in the upright orientation 110. In certain aspects, the laundry appliance 10 may include a latch sensor configured to send when the second latch features 144 are engaged with the first latch features 142. In such examples, the sensed disengagement of the second latch features 144 from the first latch features 142 may temporarily pause activation of the motor 64 for translating the door 18 vertically until the second latch assembly 144 is again engaged with the first latch features 142.

The user may then rotate the door 18 to the upright orientation 110, aligning and engaging the second latch features 144 with the first latch features 142. The user may then provide another triggering event to adjust the door 18 vertically. In certain aspects, the door 18 can be adjusted vertically when in the deployed position 122. It is also contemplated that the controller 30 can detect when the door 18 is in the deployed position 122 and may prevent vertical adjustments of the brackets 24, 26 along the rail assembly 16 while the door 18 is deployed.

Use of the present device may provide for a variety of advantages. For example, the sliding door 18 can maximize the space within the interior of the cabinet 12 of the laundry appliance 10, while minimizing space utilized by the laundry appliance 10. Additionally, the laundry appliance 10 can include the oblique bellows 70 extending between the front panel 14 and the offset tub 44. Further, the laundry appliance 10 may include the deflector 72 for protecting the bellows 70, as well as assisting in loading laundry into the drum 42. Also, the deflector 72 deflects fluid and laundry away from the bellows 70 during the laundry cycle. Additionally, the laundry appliance 10 includes the seal assembly 90 for providing a watertight seal around the front opening 40. The seal assembly 90 allows for the sliding movement of the door 18 with minimal friction between the first seal 92 and the second seal 94. Further, the seal assembly 90 can reach a fully sealed engagement as the door 18 reaches the fully closed position 20.

Moreover, the door 18 is operable along the vertical first movement path 32 between the closed position 20 and opened position 22, as well as being configured to rotate along the second movement path 118 to the deployed position 122. The configuration of the deploying assembly 130 generally allows the door 18 to be rotated to the deployed position 122 at any position between the closed position 20 and the opened position 22. Also, the deploying assembly 130 includes the latch assembly 140 to retain the door 18 in the upright orientation 110, as well as the support features 160 to retain the door 18 in the deployed position 122. Moreover, the controller 30 typically includes preprogrammed settings, which may improve or enhance the user experience with the laundry appliance 10. Additionally, the laundry appliance 10 may be in communication with the remote user device 230, which allows the user to remotely control and monitor the status of the door 18, as well as the laundry appliance 10. Additional benefits or advantages may be realized and/or achieved.

The device disclosed herein is further summarized in the following paragraphs and is further characterized by combinations of any and all of the various aspects described therein.

According to another aspect of the present disclosure, a laundry appliance includes a cabinet having a front panel. A rail assembly is disposed within the cabinet proximate to the front panel. A door is operable between a closed position and an opened position via the rail assembly. A bracket is coupled to the door. The bracket extends into the cabinet to engage the rail assembly. A sensor is coupled to the cabinet. The door is operable between the opened position and the closed position in response to a triggering event sensed by the sensor. A controller is in communication with the sensor and the rail assembly. The controller is configured to automatically adjust a movement path of the door in response to a detected obstruction in the movement path.

According to another aspect, a controller is configured to automatically adjust a door to at least one of a venting position and an add garment position. Each of the venting position and the add garment position is between an opened position and a closed position.

According to another aspect, a tub is disposed within the cabinet, oblique bellows extend between a front panel and the tub, and a deflector has a rim and a chute. The rim is coupled to the front panel and the chute extends from the rim and over the oblique bellows toward the tub.

According to another aspect, a door is configured to rotate to a deployed position.

According to another aspect, a deploying assembly is coupled to a bracket and a door. The deploying assembly includes a latch assembly to retain the door in an upright orientation and a support feature for retaining the door in a deployed position.

According to another aspect, a first seal is coupled to a front panel of a cabinet, and a second seal is coupled to an inner surface of a door. The first seal is configured to engage the second seal when the door is in a closed position to provide a watertight seal.

According to another aspect, a controller is configured to communicate with a remote user device to remotely control and monitor a door.

According to another aspect, an appliance door system includes a panel having a front surface. A door is disposed proximate to the front surface. A rail assembly is disposed on an opposing side of the panel relative to the door. A bracket is coupled to the door. The bracket extends through the panel to engage the rail assembly. The door is operable along a first movement path between an opened position and a closed position along the front surface of the panel via the rail assembly. A deploying assembly is coupled to the bracket and the door. The door is configured to rotate along a second movement path to a deployed position. The deploying assembly is configured to retain the door in the deployed position. According to another aspect, a deploying assembly includes a first latch feature disposed proximate to a front panel and a second latch feature coupled to a door. The first latch feature engages the second latch feature to retain the door in an upright orientation.

According to another aspect, a seal assembly has a first seal coupled to a front panel and a second seal coupled to an inner surface of a door. The first seal is configured to mate with the second seal when the door is in a closed position.

According to another aspect, a frame is coupled to an inner surface of a door. The second seal is coupled to the frame.

According to another aspect, a sensor is coupled to a front panel and configured to sense a triggering event. A controller is in communication with the sensor and a rail assembly. The controller is configured to activate a motor communicatively coupled to the rail assembly to move a door in response to the triggering event.

According to another aspect, a controller is configured to adjust a door from moving in a first direction path along the first movement path to a second direction path along the first movement path when the door encounters an obstruction in the first direction path.

According to another aspect, a door is configured to rotate about a horizontal rotational axis to a deployed position at any position along a first movement path. The first movement path is a vertical movement path.

According to another aspect, a first frame is coupled to a bracket. A second frame is coupled to an inner surface of a door. A support feature extends between the first frame and the second frame to retain the door in a deployed position.

According to yet another aspect, a door system for an appliance includes a panel and a door having an inner surface. A bracket is coupled to the door. A rail assembly is disposed on an opposing side of the panel relative to the door. The bracket engages the rail assembly through the panel to adjust the door between an opened position and a closed position via the rail assembly. The door is configured to rotate to a deployed position.

According to another aspect, an opened position is a lowered position at a first height and a closed position in a raised position at a second height. A door is configured to rotate to a deployed position at any height between the first height and the second height in response to a predetermined force.

According to another aspect, a deploying assembly is coupled to each of a bracket and a door. The deploying assembly is configured to retain the door in an upright orientation and a deployed position.

According to another aspect, a first seal is coupled to a panel and extends at least partially around an opening defined by the panel. A second seal is coupled to a door. The second seal is configured to mate with the first seal when the door is in a closed position.

According to another aspect, a door travels vertically between an opened position and a closed position. The door extends horizontally from a panel when in a deployed position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet panel defining an opening, wherein the cabinet panel defines slots on opposing sides of the opening that extend along a height of the cabinet panel; and a door system operably coupled with the cabinet panel, wherein the door system is operable between a raised position covering the opening and a lowered position, and wherein the door system includes:

a first frame having side portions forming first and second uprights that are spaced from one another and positioned on the opposing sides of the opening, respectively, when in the raised position, the first frame positioned adjacent to a front surface of the cabinet panel;

brackets extending from the side portions of the first frame, wherein the brackets extend through the slots of the cabinet panel;

first latch features coupled to the first and second uprights of the first frame, respectively;

a second frame operably coupled to the first frame, wherein the second frame is operable between an upright position fit between the side portions of the first frame and a deployed position where a top edge of the second frame is moved away from the first frame, wherein the second frame is configured to engage the first latch features of the first frame at the first and second uprights; and a door panel coupled to the second frame and configured to move between the upright position and the deployed position with the second frame.

2. The laundry appliance of claim 1, wherein a bottom edge of the second frame remains engaged with the first frame when in the upright position and when in the deployed position.

3. The laundry appliance of claim 1, wherein an upper edge of the door panel is disposed adjacent to the front surface when in the upright position, and wherein the door panel is configured to rotate about a horizontal rotational axis to move the upper edge away from the front surface to the deployed position.

4. The laundry appliance of claim 1, further comprising:

second latch features coupled to an inner surface of the door panel, wherein the second latch features are configured to engage the first latch features to retain the door panel in the upright position.

5. The laundry appliance of claim 1, wherein the first frame has a U-shaped construction to extend around a bottom portion of the opening when in the raised position.

6. The laundry appliance of claim 5, wherein the second frame has a U-shaped construction.

7. The laundry appliance of claim 1, wherein pivot points are defined between the first frame and the second frame, and wherein the pivot points are disposed proximate to a lower edge of the door panel.

8. A laundry appliance door system, comprising:

a door panel;

a first frame having a first upright spaced from a second upright;

a second frame rotatably coupled to the first frame at pivot points, wherein the second frame is coupled to an inner surface of the door panel with the pivot points positioned proximate to a bottom edge of the door panel, and wherein the door panel is operable between an upright position with the second frame positioned between the first and second uprights for vertical movement between opened and closed positions and a deployed position with a top edge of the door panel rotated away from tops of the first and second uprights;

first latch features coupled to the tops of the first and second uprights, respectively;

second latch features coupled to the inner surface of the door panel on outer sides of the second frame, wherein the second latch features are configured to engage the first latch features to retain the door panel in the upright position; and support features extending from the first and second uprights to the second frame to retain the door panel in the deployed position.

9. The laundry appliance door system of claim 8, further comprising:

slides coupled to the support features, wherein the first frame defines tracks on the first and second uprights, respectively, and wherein the slides are configured to move along the tracks to change a connection point between the support features and the first frame to, consequently, change an orientation of the door panel in the deployed position.

10. The laundry appliance door system of claim 9, wherein the tracks include open ends for disengaging the slides from the first frame.

11. The laundry appliance door system of claim 8, further comprising:

brackets extending from the first and second uprights, respectively, for engaging a cabinet panel.

12. The laundry appliance door system of claim 11, further comprising:

rails, wherein the brackets engage the rails, respectively, for adjusting the door panel between the opened and closed positions.

13. The laundry appliance door system of claim 12, further comprising:

a drive system operably coupled with the rails, wherein the drive system includes a motor to provide motorized movement of the door panel along the rails.

14. The laundry appliance door system of claim 13, further comprising:

a sensor; and a controller communicatively coupled with the drive system and the sensor, wherein the controller is configured to automatically change a movement direction of the door panel along the rails via the drive system in response to at least one of a triggering event and an obstruction sensed by the sensor.

15. The laundry appliance door system of claim 8, further comprising:

a seal coupled to the inner surface of the door panel and the second frame.

16. A door system for a laundry appliance, comprising:

a door panel;

a seal coupled to an inner surface of the door panel and configured to mate with a gasket extending around an opening for said laundry appliance;

a first frame having first and second uprights;

a second frame coupled to the inner surface of the door panel and to the seal, wherein the second frame is rotatably coupled to the first frame at pivot points adjacent to a bottom edge of the door panel, and wherein the door panel is operable between an upright position with the second frame fit within the first frame and a deployed position with a top edge of the door panel rotated away from the first and second uprights;

first latch features coupled to the first and second uprights, respectively; and second latch features coupled to the inner surface of the door panel on outer sides of the second frame, wherein the second latch features are configured to engage the first latch features to retain the door panel in the upright position.

17. The door system of claim 16, wherein the seal extends along an inner edge of the second frame.

18. The door system of claim 16, wherein the second frame is positioned adjacent to an inner edge of the first frame when the door panel is in the upright position.

19. The door system of claim 16, further comprising:

support features extending from the first and second uprights to the second frame to retain the door panel in the deployed position.

20. The door system of claim 16, wherein the first and second latch features are at least one of magnets, push-push connectors, snap features, and hook and loop fasteners.

* * * * *